US011282629B2

(12) United States Patent
Yamauchi et al.

(10) Patent No.: US 11,282,629 B2
(45) Date of Patent: Mar. 22, 2022

(54) MULTILAYER INDUCTOR

(71) Applicant: Murata Manufacturing Co., Ltd., Kyoto-fu (JP)

(72) Inventors: Kouji Yamauchi, Nagaokakyo (JP); Toshihiko Fukushima, Nagaokakyo (JP); Hideo Ajichi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 781 days.

(21) Appl. No.: 16/010,220

(22) Filed: Jun. 15, 2018

(65) Prior Publication Data

US 2018/0374628 A1 Dec. 27, 2018

(30) Foreign Application Priority Data

Jun. 26, 2017 (JP) ..... JP2017-124084

(51) Int. Cl.
*H01F 5/00* (2006.01)
*H01F 27/28* (2006.01)
(Continued)

(52) U.S. Cl.
CPC ..... *H01F 27/2804* (2013.01); *H01F 17/0013* (2013.01); *H01F 27/24* (2013.01);
(Continued)

(58) Field of Classification Search
CPC .... H01F 27/2804; H01F 27/24; H01F 27/323; H01F 2027/2809; H01F 27/245; H01F 17/0013; H01F 2017/0066
(Continued)

(56) References Cited

U.S. PATENT DOCUMENTS 7,446,638 B2 * 11/2008 Nogi ..... H01F 3/14 336/200
7,817,007 B2 * 10/2010 Lee ..... H01F 17/0013 336/200
(Continued)

FOREIGN PATENT DOCUMENTS

JP 2008-053368 A 3/2008
JP 2008053368 A * 3/2008
(Continued)

OTHER PUBLICATIONS

An Office Action; "Notification of Reasons for Refusal," Mailed by the Japanese Patent Office dated Aug. 20, 2019, which corresponds to Japanese Patent Application No. 2017-124084 and is related to U.S. Appl. No. 16/010,220; with English language translation.

*Primary Examiner* — Alexander Talpalatski
*Assistant Examiner* — Joselito S. Baisa
(74) *Attorney, Agent, or Firm* — Studebaker & Brackett PC

(57) ABSTRACT

The multilayer inductor includes a multilayer body including a plurality of insulating layers laminated in a lamination direction, and a plurality of coil groups arranged in the multilayer body along the lamination direction and connected in series. Each of the coil groups includes a plurality of coil patterns respectively provided on the insulating layers and laminated in the lamination direction, and is configured by connecting a plurality of pattern groups in series. Each of the pattern groups is formed by connecting n (n is a positive integer) coil patterns in parallel. The number of parallels n of at least one of the coil groups is different from the number of parallels n of another coil group. The insulating layers include magnetic and non-magnetic insulating layers. At least one of the insulating
(Continued)

layers adjacent to one of the coil patterns is the non-magnetic insulating layer.

13 Claims, 28 Drawing Sheets

(51) Int. Cl.
*H01F 27/24* (2006.01)
*H01F 27/32* (2006.01)
*H01F 17/00* (2006.01)

(52) U.S. Cl.
CPC ... *H01F 27/323* (2013.01); *H01F 2017/0066* (2013.01); *H01F 2017/0073* (2013.01); *H01F 2027/2809* (2013.01)

(58) Field of Classification Search
USPC ..... 336/200
See application file for complete search history.

(56) References Cited

U.S. PATENT DOCUMENTS 7,834,735 B2 * 11/2010 Iwasaki ..... H01F 17/0013 336/200
8,395,471 B2 * 3/2013 Nakatsuji ..... H01F 17/0013 336/200
8,587,400 B2 * 11/2013 Nakajima ..... H01F 3/14 336/200
8,669,839 B2 * 3/2014 Yokoyama ..... H01F 27/292 336/200
9,142,344 B2 * 9/2015 Tachibana ..... H01F 27/2804
9,510,451 B2 * 11/2016 Noguchi ..... H05K 1/165
10,593,466 B2 * 3/2020 Kitajima ..... H01F 27/2804
10,825,598 B2 * 11/2020 Chung ..... H01F 17/0013
10,930,420 B2 * 2/2021 Hachiya ..... H01F 17/0013
2009/0295526 A1 * 12/2009 Mikami ..... C01G 53/006 336/196
2010/0201473 A1 8/2010 Konoue et al.
2011/0001599 A1 * 1/2011 Takenaka ..... H01F 17/0013 336/200

FOREIGN PATENT DOCUMENTS

JP 2009044030 A 2/2009
JP 2013105807 A 5/2013
JP 2013118396 A 6/2013
WO 2011145517 A1 11/2011

* cited by examiner

FIG. 14A

| | COIL PATTERN | INSERTION POSITION |
|---|---|---|
| THIRD COIL GROUP | SINGLE WINDING | ○ |
| | SINGLE WINDING | ○ |
| | SINGLE WINDING | ○ |
| SECOND COIL GROUP | DOUBLE WINDING | |
| | DOUBLE WINDING | |
| | DOUBLE WINDING | |
| | DOUBLE WINDING | |
| | DOUBLE WINDING | |
| | DOUBLE WINDING | |
| | DOUBLE WINDING | |
| | DOUBLE WINDING | |
| | DOUBLE WINDING | |
| | DOUBLE WINDING | |
| | DOUBLE WINDING | |
| | DOUBLE WINDING | ○ |
| FIRST COIL GROUP | SINGLE WINDING | ○ |
| | SINGLE WINDING | ○ |
| | SINGLE WINDING | ○ |

FIG. 14B

| | COIL PATTERN | INSERTION POSITION |
|---|---|---|
| FIFTH COIL GROUP | SINGLE WINDING | ○ |
| | SINGLE WINDING | ○ |
| FOURTH COIL GROUP | DOUBLE WINDING | |
| | DOUBLE WINDING | |
| | DOUBLE WINDING | |
| | DOUBLE WINDING | ○ |
| THIRD COIL GROUP | SINGLE WINDING | ○ |
| | SINGLE WINDING | ○ |
| | SINGLE WINDING | ○ |
| | SINGLE WINDING | ○ |
| | SINGLE WINDING | ○ |
| | SINGLE WINDING | ○ |
| SECOND COIL GROUP | DOUBLE WINDING | |
| | DOUBLE WINDING | |
| | DOUBLE WINDING | |
| | DOUBLE WINDING | ○ |
| FIRST COIL GROUP | SINGLE WINDING | ○ |
| | SINGLE WINDING | ○ |

FIG. 14C

| | COIL PATTERN | INSERTION POSITION |
|---|---|---|
| THIRD COIL GROUP | DOUBLE WINDING | |
| | DOUBLE WINDING | |
| | DOUBLE WINDING | |
| | DOUBLE WINDING | |
| | DOUBLE WINDING | |
| | DOUBLE WINDING | ○ |
| SECOND COIL GROUP | SINGLE WINDING | ○ |
| | SINGLE WINDING | ○ |
| | SINGLE WINDING | ○ |
| | SINGLE WINDING | ○ |
| | SINGLE WINDING | ○ |
| | SINGLE WINDING | ○ |
| FIRST COIL GROUP | DOUBLE WINDING | |
| | DOUBLE WINDING | |
| | DOUBLE WINDING | |
| | DOUBLE WINDING | |
| | DOUBLE WINDING | |
| | DOUBLE WINDING | |

FIG. 14D

| | COIL PATTERN | INSERTION POSITION |
|---|---|---|
| SEVENTH COIL GROUP | SINGLE WINDING | ○ |
| | SINGLE WINDING | ○ |
| | SINGLE WINDING | ○ |
| SIXTH COIL GROUP | DOUBLE WINDING | |
| | DOUBLE WINDING | |
| FIFTH COIL GROUP | TRIPLE WINDING | |
| | TRIPLE WINDING | |
| | TRIPLE WINDING | |
| FOURTH COIL GROUP | QUADRUPLE WINDING | |
| | QUADRUPLE WINDING | |
| THIRD COIL GROUP | TRIPLE WINDING | |
| | TRIPLE WINDING | |
| | TRIPLE WINDING | |
| SECOND COIL GROUP | DOUBLE WINDING | |
| | DOUBLE WINDING | ○ |
| FIRST COIL GROUP | SINGLE WINDING | ○ |
| | SINGLE WINDING | ○ |
| | SINGLE WINDING | ○ |

FIG. 14E

| | COIL PATTERN | INSERTION POSITION |
|---|---|---|
| SECOND COIL GROUP | SINGLE WINDING | ○ |
| | SINGLE WINDING | ○ |
| FIRST COIL GROUP | DOUBLE WINDING | |
| | DOUBLE WINDING | |
| | DOUBLE WINDING | |
| | DOUBLE WINDING | |
| | DOUBLE WINDING | |
| | DOUBLE WINDING | |
| | DOUBLE WINDING | |
| | DOUBLE WINDING | |
| | DOUBLE WINDING | |
| | DOUBLE WINDING | |
| | DOUBLE WINDING | |
| | DOUBLE WINDING | |
| | DOUBLE WINDING | |
| | DOUBLE WINDING | |
| | DOUBLE WINDING | |
| | DOUBLE WINDING | |

FIG. 14F

| | COIL PATTERN | INSERTION POSITION |
|---|---|---|
| THIRD COIL GROUP | TRIPLE WINDING | |
| | TRIPLE WINDING | |
| | TRIPLE WINDING | |
| | TRIPLE WINDING | |
| | TRIPLE WINDING | |
| | TRIPLE WINDING | ○ |
| SECOND COIL GROUP | DOUBLE WINDING | ○ |
| | DOUBLE WINDING | ○ |
| | DOUBLE WINDING | ○ |
| | DOUBLE WINDING | ○ |
| | DOUBLE WINDING | ○ |
| | DOUBLE WINDING | ○ |
| FIRST COIL GROUP | TRIPLE WINDING | |
| | TRIPLE WINDING | |
| | TRIPLE WINDING | |
| | TRIPLE WINDING | |
| | TRIPLE WINDING | |
| | TRIPLE WINDING | |

| STRUCTURE | HEAT GENERATION AMOUNT [W] | MAGNETIC INSULATING LAYER PORE AREA RATIO | NON-MAGNETIC INSULATING LAYER PORE AREA RATIO | NG OCCURRENCE RATE AFTER 3000 h |
|---|---|---|---|---|
| COMPARATIVE EXAMPLE | 0.20 | 9% | 10% | 0% |
| | 0.22 | 9% | 10% | 2% |
| | 0.24 | 9% | 10% | 5% |
| | 0.26 | 9% | 10% | 15% |
| SIXTH EMBODIMENT | 0.20 | 9% | 1% | 0% |
| | 0.22 | 9% | 1% | 0% |
| | 0.24 | 9% | 1% | 3% |
| | 0.26 | 9% | 1% | 5% |

FIG. 22

| STRUCTURE | HEAT GENERATION AMOUNT [W] | MAGNETIC INSULATING LAYER PORE AREA RATIO | NON-MAGNETIC INSULATING LAYER PORE AREA RATIO | NG OCCURRENCE RATE AFTER 3000 h |
|---|---|---|---|---|
| SIXTH EMBODIMENT | 0.20 | 9% | 1% | 0% |
| | 0.22 | 9% | 1% | 0% |
| | 0.24 | 9% | 1% | 3% |
| | 0.26 | 9% | 1% | 5% |
| EIGHTH EMBODIMENT | 0.20 | 9% | 1% | 0% |
| | 0.22 | 9% | 1% | 0% |
| | 0.24 | 9% | 1% | 0% |
| | 0.26 | 9% | 1% | 2% |

MULTILAYER INDUCTOR

CROSS-REFERENCE TO RELATED APPLICATION

This application claims benefit of priority to Japanese Patent Application No. 2017-124084, filed Jun. 26, 2017, the entire content of which is incorporated herein by reference.

BACKGROUND

Technical Field

The present disclosure relates to a multilayer inductor.

Background Art

As an existing multilayer inductor, there is a multilayer inductor disclosed in Japanese Unexamined Patent Application Publication No. 2008-53368. This multilayer inductor includes a multilayer body in which a plurality of insulating layers are laminated, first and second outer electrodes disposed on an outer surface of the multilayer body, and a plurality of conductor portions disposed in the multilayer body along a lamination direction of the plurality of insulating layers and connected between the first outer electrode and the second outer electrode in series.

The plurality of conductor portions include a first conductor portion formed of at least two first conductor patterns and a second conductor portion formed of one second conductor pattern. The at least two first conductor patterns have substantially the same shape and are disposed so as to continue in the lamination direction, in which each one end thereof is electrically connected to the first outer electrode so as to be connected in parallel and the other ends thereof are electrically connected to each other. In the second conductor pattern, one end thereof is electrically connected to the second outer electrode and the other end thereof is electrically connected to the first outer electrode with the at least two first conductor patterns interposed therebetween. With this, a DC resistance is reduced, and a Q value is ensured.

Incidentally, if an attempt is made to use a multilayer inductor such as the existing one, it has been found that the Q value can be ensured, but a structure thereof is not sufficient in terms of voice distortion.

SUMMARY

Accordingly, the present disclosure provides a multilayer inductor capable of improving voice distortion characteristics while ensuring a Q value.

In order to solve the aforementioned problem, a multilayer inductor according to preferred embodiments of the present disclosure includes a multilayer body including a plurality of insulating layers laminated in a lamination direction; and a plurality of coil groups arranged in the multilayer body along the lamination direction and connected in series, in which the coil group includes a plurality of coil patterns respectively provided on the insulating layers and laminated in the lamination direction, and is configured by connecting a plurality of pattern groups in series. A pattern group is formed by connecting n (n is a positive integer) coil patterns in parallel, with the number of parallels n of at least one of the coil groups being different from the number of parallels n of another coil group. The plurality of insulating layers include a magnetic insulating layer and a non-magnetic insulating layer, and at least one of the insulating layers adjacent to the coil pattern is the non-magnetic insulating layer.

In the multilayer inductor according to the preferred embodiments of the present disclosure, since the non-magnetic insulating layer is provided in the coil groups with different numbers of parallels, a magnetic flux is suppressed, and thus voice distortion characteristics are improved. Additionally, the coil groups with different numbers of parallels are included, and thus a DC resistance is reduced and a Q value is ensured.

Additionally, in a preferred embodiment of the multilayer inductor, at least one of the insulating layers adjacent to the coil pattern included in the coil group having the least number of parallels n is the non-magnetic insulating layer. According to the preferred embodiment, although, in the coil group having the least number of parallels n, a large current flows and a magnetic flux increases, since at least one of the insulating layers adjacent to the coil pattern included in this coil group is the non-magnetic insulating layer, the magnetic flux is suppressed, a hysteresis linearity is improved, and thus the voice distortion characteristics are improved.

Additionally, in a preferred embodiment of the multilayer inductor, the insulating layer located at the center of the coil group having the least number of parallels n in the lamination direction is the non-magnetic insulating layer. According to the preferred embodiment, since the insulating layer located at the center of the coil group in the lamination direction is the non-magnetic insulating layer, by disposing the non-magnetic insulating layer at the center portion with a high magnetic flux density, the magnetic flux is suppressed, and thus the voice distortion characteristics are improved.

Additionally, in a preferred embodiment of the multilayer inductor, the coil group having the least number of parallels n is disposed in an outer side portion in the lamination direction. According to the preferred embodiment, although, in the coil group having the least number of parallels n, a large current flows and heat generation increases, by disposing this coil group in the outer side portion in the lamination direction, heat radiation characteristics of a chip are improved and a rated current can be increased.

Additionally, in a preferred embodiment of the multilayer inductor, a pore area ratio of the multilayer body in a side gap portion which is a region between a side portion of the coil pattern and a side surface of the multilayer body is not less than about 6% and not more than about 20% (i.e., from about 6% to about 20%).

According to the preferred embodiment, permeation of an acidic solution including a metal from the side surface of the multilayer body through the side gap portion to reach a boundary surface between the coil pattern and the insulating layer in the periphery thereof makes the boundary surface between the coil pattern and the insulating layer a chemically dissociated state. With this, a stress of the multilayer body can be eased, inhibition of a magnetic domain wall movement necessary for the magnetic insulating layer to exhibit magnetic characteristics is reduced, the hysteresis linearity is improved, and thus the voice distortion characteristics are improved.

Additionally, in a preferred embodiment of the multilayer inductor, a pore area ratio of the non-magnetic insulating layer is smaller than a pore area ratio of the magnetic insulating layer. According to the preferred embodiment, although the non-magnetic insulating layer adjacent to the coil pattern of the coil group in which a large current flows is located at a position with a high risk of a short-circuit due to an electrochemical migration under a high temperature and high humidity environment or the like, by reducing the pore area ratio of this non-magnetic insulating layer, reliability at the high risk position is improved, and thus the reliability of the multilayer inductor can be improved as a whole (the short-circuit risk can be reduced).

Additionally, in a preferred embodiment of the multilayer inductor, a thickness of the non-magnetic insulating layer is thinner than a thickness of the magnetic insulating layer. According to the preferred embodiment, by increasing the density of the non-magnetic insulating layer, even if the non-magnetic insulating layer is thinned, a high environment-resistant performance can be exhibited. Additionally, by the non-magnetic insulating layer being thinned, high impedance characteristics can be enhanced.

Additionally, in a preferred embodiment of the multilayer inductor, the insulating layer located between adjacent pattern groups of the coil group having the least number of parallels n is the non-magnetic insulating layer. According to the preferred embodiment, since the adjacent pattern groups have different potentials, in a case where a short-circuit occurs between the adjacent pattern groups, influence on impedance arises. By disposing the non-magnetic insulating layer with a small pore area ratio between these adjacent pattern groups, the reliability of the multilayer inductor can be improved as a whole (the short-circuit risk can be reduced).

Other features, elements, characteristics and advantages of the present disclosure will become more apparent from the following detailed description of preferred embodiments of the present disclosure with reference to the attached drawings.

BRIEF DESCRIPTION OF THE DRAWINGS

FIG. 14A is a schematic diagram of the multilayer inductor including a single winding first coil group, a double winding second coil group, and a single winding third coil group;

FIG. 14B is a schematic diagram of the multilayer inductor including a single winding first coil group, a double winding second coil group, a single winding third coil group, a double winding fourth coil group, and a single winding fifth coil group;

FIG. 14C is a schematic diagram of the multilayer inductor including a double winding first coil group, a single winding second coil group, and a double winding third coil group;

FIG. 14D is a schematic diagram of the multilayer inductor including a single winding first coil group, a double winding second coil group, a triple winding third coil group, a quadruple winding fourth coil group, a triple winding fifth coil group, a double winding sixth coil group, and a single winding seventh coil group;

FIG. 14E is a schematic diagram of the multilayer inductor including a double winding first coil group, and a single winding second coil group;

FIG. 14F is a schematic diagram of the multilayer inductor including a triple winding first coil group, a double winding second coil group, and a triple winding third coil group;

FIG. 22 illustrates test results of the eighth embodiment and the sixth embodiment.

DETAILED DESCRIPTION

Figure 1:
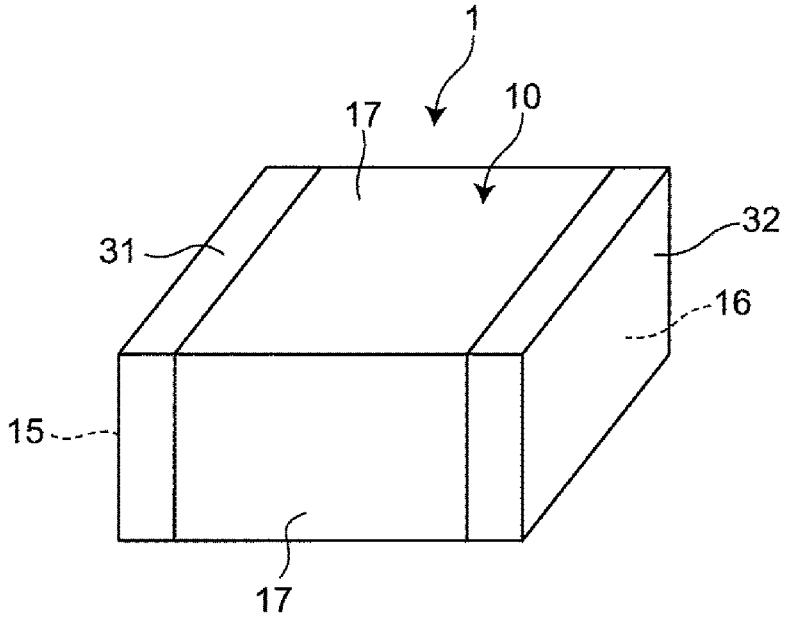
FIG. 1 is a perspective view illustrating a first embodiment of a multilayer inductor of the present disclosure.

Hereinafter, the present disclosure will be described in detail according to embodiments illustrated in the drawings.

First Embodiment

FIG. 1 is a perspective view illustrating a first embodiment of a multilayer inductor of the present disclosure. FIG.

Figure 2A:
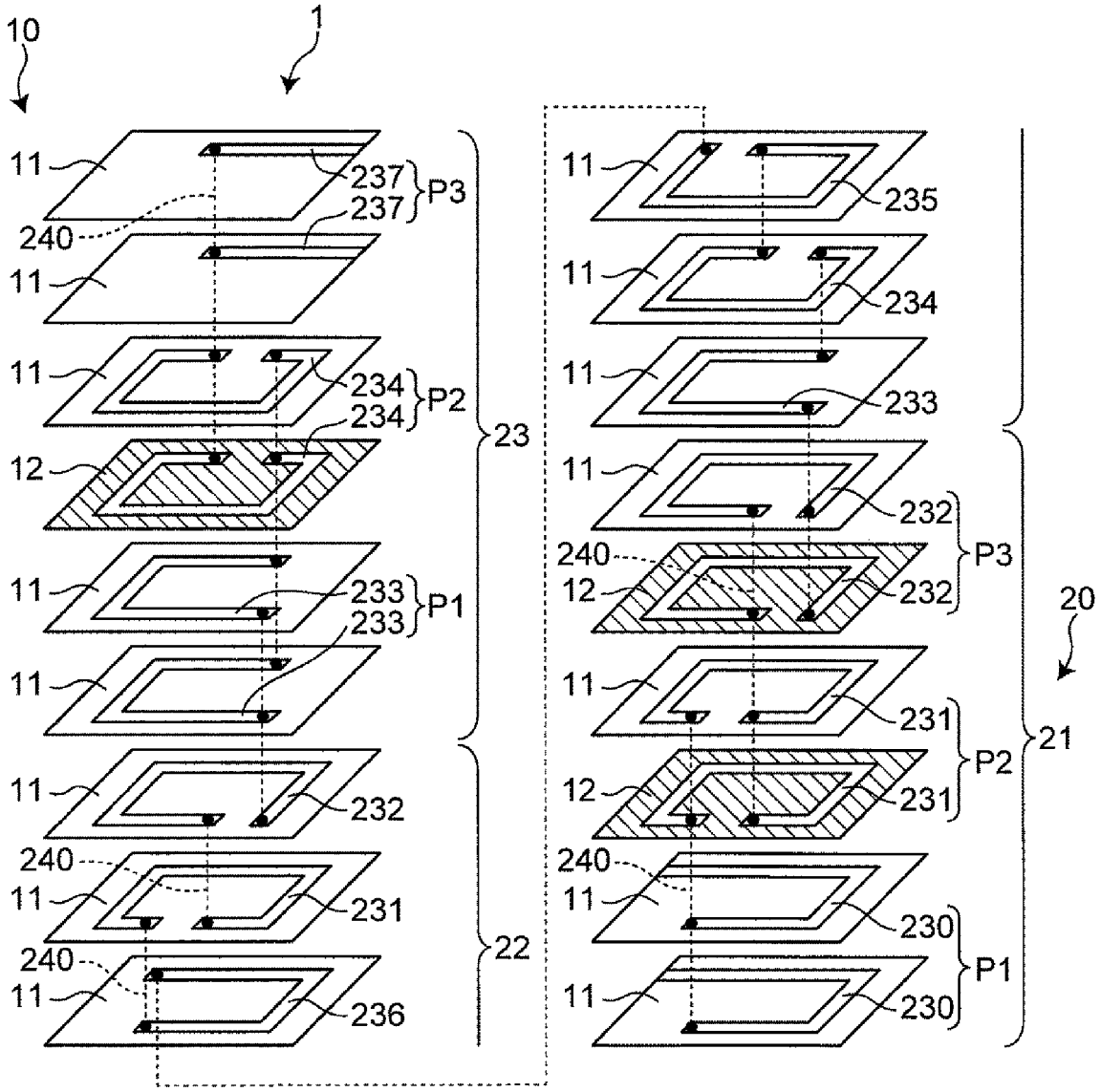
FIG. 2A is an exploded perspective view of the multilayer inductor of the present disclosure.
Figure 2B:
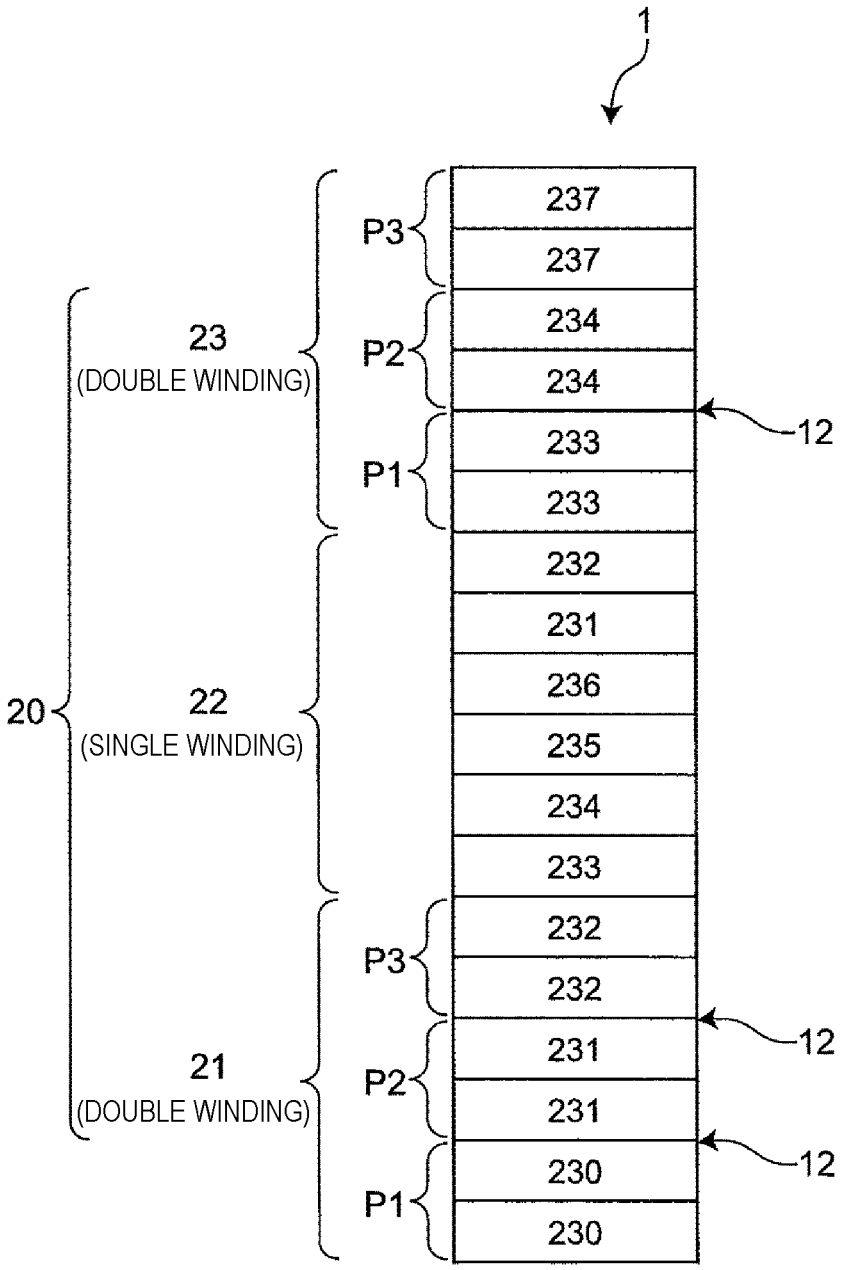
FIG. 2B is a schematic diagram of the multilayer inductor of the present disclosure.

2A is an exploded perspective view of the multilayer inductor of the present disclosure. FIG. 2B is a schematic diagram of the multilayer inductor of the present disclosure. As illustrated in FIG. 1, FIG. 2A, and FIG. 2B, a multilayer inductor 1 includes a multilayer body 10, a coil 20 provided in the inside of the multilayer body 10, a first outer electrode 31 and a second outer electrode 32 provided on a surface of the multilayer body 10 and electrically connected to the coil 20.

The multilayer inductor 1 is electrically connected to wirings of a circuit substrate, which is not illustrated, with the first and second outer electrodes 31 and 32 interposed therebetween. The multilayer inductor 1 is, for example, used as a noise removal filter, used in electronic devices such as personal computers, DVD players, digital cameras, TVs, cellular phones, car electronics, or the like. The multilayer body 10 includes a plurality of insulating layers 11 and 12, and the plurality of insulating layers 11 and 12 are laminated in a lamination direction. The plurality of insulating layers 11 and 12 include a magnetic insulating layer 11 and a non-magnetic insulating layer 12. Magnetic permeability of the non-magnetic insulating layer 12 is lower than magnetic permeability of the magnetic insulating layer 11. The magnetic insulating layer 11 is, for example, formed of a magnetic material such as an Ni—Cu—Zn based material or the like. The non-magnetic insulating layer 12 is, for example, formed of a non-magnetic material such as a Cu—Zn based material or the like. In FIG. 2A, the non-magnetic insulating layer 12 is illustrated by hatching.

The multilayer body 10 is formed in a substantially rectangular parallelepiped shape. The surface of the multilayer body 10 includes a first end surface 15, a second end surface 16 located on an opposite side from the first end surface 15, four side surfaces 17 located between the first end surface 15 and the second end surface 16. The first end surface 15 and the second end surface 16 are opposite to each other in a direction orthogonal to the lamination direction.

The first outer electrode 31 covers the entire surface of the first end surface 15 of the multilayer body 10 and end portions of the side surfaces 17 of the multilayer body 10 on the first end surface 15 side. The second outer electrode 32 covers the entire surface of the second end surface 16 of the multilayer body 10 and end portions of the side surfaces 17 of the multilayer body 10 on the second end surface 16 side.

The coil 20 is wound along the lamination direction in a substantially spiral shape. A first end of the coil 20 is exposed from the first end surface 15 of the multilayer body 10 and electrically connected to the first outer electrode 31. A second end of the coil 20 is exposed from the second end surface 16 of the multilayer body 10 and electrically connected to the second outer electrode 32. The coil 20 is, for example, formed of a conductive material such as Ag, Cu, or the like.

The coil 20 includes a first coil group 21, a second coil group 22, and a third coil group 23. The first coil group 21, the second coil group 22, and the third coil group 23 are arranged in the multilayer body 10 along the lamination direction, and connected in series between the first outer electrode 31 and the second outer electrode 32.

The first coil group 21 includes a plurality of coil patterns 230, 231, and 232 respectively provided on the insulating layers 11 and 12 and laminated in the lamination direction. The first coil group 21 is configured by connecting three pattern groups P1, P2, and P3 in series. The three pattern groups P1, P2, and P3 are formed, respectively, by connecting two coil patterns 230 and 230, 231 and 231, and 232 and 232 in parallel. In other words, the number of parallels of the first coil group 21 is two, to rephrase, the first coil group 21 is in a state of double winding.

To be specific, the first pattern group P1 is formed by connecting the two coil patterns 230 and 230 in parallel. The second pattern group P2 is formed by connecting the two coil patterns 231 and 231 in parallel. The third pattern group P3 is formed by connecting the two coil patterns 232 and 232 in parallel.

The two coil patterns 230 and 230 of the first pattern group P1 have substantially the same shape, the two coil patterns 231 and 231 of the second pattern group P2 have substantially the same shape, the two coil patterns 232 and 232 of the third pattern group P3 have substantially the same shape. Hereinafter, when the coil patterns are given the same reference numerals, the coil patterns are assumed to have substantially the same shape.

The coil patterns 230, 231, and 232 each have a substantially planar spiral shape which is wound in a substantially planar shape by less than about one turn. A first end of each of the two coil patterns 230 and 230 is connected to the first outer electrode 31, a second end of each of the two coil patterns 230 and 230 are connected to each other with a pattern connection portion 240 interposed therebetween. With this, the two coil patterns 230 and 230 have the same potential. The pattern connection portion 240 is provided so as to pass through the insulating layers 11 and 12 in the lamination direction.

First ends of the two coil patterns 231 and 231 are connected to each other with the predetermined pattern connection portion 240 interposed therebetween, and second ends of the two coil patterns 231 and 231 are connected to each other with another pattern connection portion 240 interposed therebetween. With this, the two coil patterns 231 and 231 have the same potential.

First ends of the two coil patterns 232 and 232 are connected to each other with the predetermined pattern connection portion 240 interposed therebetween, and second ends of the two coil patterns 232 and 232 are connected to each other with another pattern connection portion 240 interposed therebetween. With this, the two coil patterns 232 and 232 have the same potential.

The second end of the coil pattern 230 and the first end of the coil pattern 231 are connected to each other with the predetermined pattern connection portion 240 interposed therebetween, and the second end of the coil pattern 231 and the first end of the coil pattern 232 are connected to each other with the predetermined pattern connection portion 240 interposed therebetween. With this, the two coil patterns 230 and 230 (first pattern group P1), the two coil patterns 231 and 231 (second pattern group P2), and the two coil patterns 232 and 232 (third pattern group P3) are connected in series.

The second coil group 22 includes the coil patterns 231 and 232 and a plurality of coil patterns 233 to 236 respectively provided on the insulating layers 11 and laminated in the lamination direction. The second coil group 22 is configured by connecting six pattern groups in series. Each of the six pattern groups is formed by connecting each one of the coil patterns 231 to 236 in parallel. In other words, the number of parallels of the second coil group 22 is one, to rephrase, the second coil group 22 is in a state of single winding. The six coil patterns 231 to 236 are connected in series with the pattern connection portions 240 interposed therebetween.

The third coil group 23 includes a plurality of coil patterns 233, 234, and 237 provided on the insulating layers 11 and 12 and laminated in the lamination direction. The third coil group 23 is configured by connecting three pattern groups P1, P2, and P3 in series. The three pattern groups P1, P2, and P3 are formed, respectively, by connecting the two coil patterns 233 and 233, 234 and 234, and 237 and 237 in parallel. In other words, the number of parallels of the third coil group 23 is two, to rephrase, the third coil group 23 is in a state of double winding. The specific configuration of the third coil group 23 is the same as the configuration of the first coil group 21, and thus, description thereof is omitted. The coil pattern 237 corresponds to an extended line.

As described above, the number of parallels of the second coil group 22 (which is one) is different from the number of parallels of the first and third coil groups 21 and 23 (which is two). Additionally, at least one of the insulating layers adjacent to the coil patterns 230 to 237 is the non-magnetic insulating layer 12. To be specific, the non-magnetic insulating layer 12 is located between the first pattern group P1 and the second pattern group P2 of the first coil group 21, located between the second pattern group P2 and the third pattern group P3 of the first coil group 21, and located between the first pattern group P1 and the second pattern group P2 of the third coil group 23.

According to the multilayer inductor 1, since the number of parallels of the first and third coil groups 21 and 23 is two, a DC resistance is reduced, and a Q value is ensured. Additionally, since the non-magnetic insulating layers 12 are provided in the coil groups 21, 22, and 23 having different numbers of parallels, a magnetic flux is suppressed, and thus voice distortion characteristics are improved. To be specific, by a magnetic flux suppression effect by insertion of the non-magnetic insulating layer 12, a hysteresis linearity is enhanced, and as a result, voice distortion THD+N [%] is enhanced.

Figure 3:
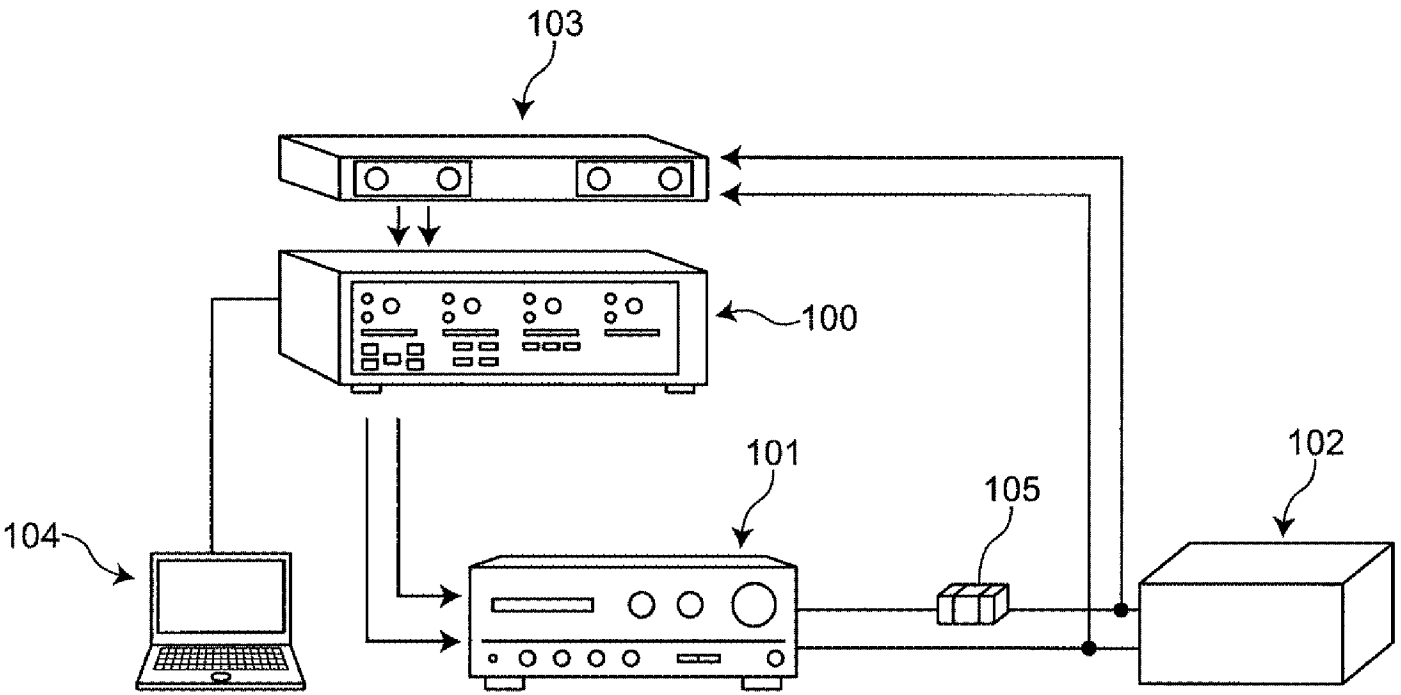
FIG. 3 is a schematic diagram illustrating a measurement device for measuring voice distortion THD+N.

FIG. 3 illustrates a measurement device for measuring the voice distortion THD+N. As illustrated in FIG. 3, the measurement device includes an audio analyzer 100, an amplifier 101, a dummy resistor 102, a filter 103, a control device 104. The audio analyzer 100, the amplifier 101, and the filter 103 are connected with a signal line in a substantially ring shape. The control device 104 is connected to the audio analyzer 100. The dummy resistor 102 is connected between the amplifier 101 and the filter 103. A measurement target component 105 is installed between the amplifier 101 and the filter 103.

The audio analyzer 100 performs signal generation and signal analysis, and APx525 manufactured by Comes Technologies Limited is used. For the amplifier 101, A636 manufactured by PIONEER CORPORATION is used. For the dummy resistor 102, a resistor of about 8Ω is used. For the filter 103, AP AUX-0025 is used. For the control device 104, a computer is used.

As the measurement target component 105, the multilayer inductor 1 of the present embodiment illustrated in FIG. 2A and a multilayer inductor of a comparative example were used. The comparative example has a configuration in which all the non-magnetic insulating layers 12 in FIG. 2A are replaced with the magnetic insulating layers 11, which is the same as that of the existing technique (Japanese Unexamined Patent Application Publication No. 2008-53368). Additionally, the voice distortion was measured with a measurement frequency being set at about 1 kHz.

Figure 4:
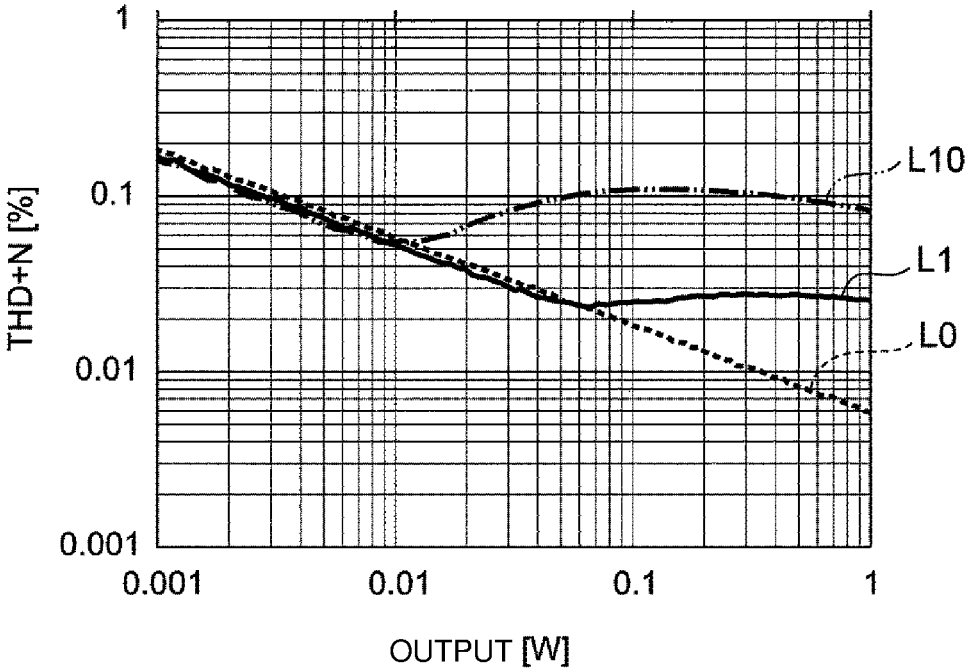
FIG. 4 is a graph of a measurement result of the voice distortion.

FIG. 4 illustrates a graph of a measurement result of the voice distortion. A graph L1 illustrates a measurement result of the multilayer inductor of the first embodiment. A graph L10 illustrates a measurement result of the multilayer inductor of the comparative example. A graph L0 illustrates a measurement result when the measurement target component 105 is not installed (that is, a short-circuit state). As is clear from FIG. 4, the multilayer inductor of the first embodiment (graph L1) could improve the voice distortion THD+N [%] in comparison with the multilayer inductor of the comparative example (graph L10).

In the embodiment, the number of the coil groups may be plural other than three. At this time, the coil group is configured by connecting a plurality of pattern groups, each of which is formed by connecting n (n is a positive integer) coil patterns in parallel, in series. The number of parallels n of at least one coil group is different from the number of parallels n of another coil group. At least one of the insulating layers adjacent to the coil patterns is the non-magnetic insulating layer.

Next, a working example of the first embodiment will be described.

(1) Manufacture of Non-Magnetic Sheet (Non-Magnetic Insulating Layer)

In the present working example, as a non-magnetic material, a Cu—Zn based material was used. First, a material in a ratio of about 48 mol % ferric oxide ($Fe_2O_3$), about 43 mol % zinc oxide (ZnO), and about 9 mol % copper oxide (CuO) was, as a raw material, subjected to wet mixing with a ball mill for a predetermined time. The obtained mixture was dried and then pulverized, the obtained powder was calcined at about 750° C. for about one hour. This ferrite powder to which a binder resin, a plasticizer, a wetting agent, and a dispersant were added was mixed by the ball mill for a predetermined time, then subjected to degassing by reducing pressure to obtain slurry. By applying this slurry on a base material such as a PET film or the like and then drying it, a ferrite green sheet being a non-magnetic body material with a desired film thickness was manufactured.

(2) Manufacture of Magnetic Sheet (Magnetic Insulating Layer)

Additionally, as a magnetic body material, a Ni—Cu—Zn based material was used. A material in a ratio of about 47.4 mol % $Fe_2O_3$, about 20.6 mol % ZnO, about 8.3 mol % CuO, and about 23.7 mol % nickel oxide (NiO) was, as a raw material, processed through the same method as in the above-described non-magnetic body to obtain slurry. By applying this slurry on a PET film which is a base material and then drying it, a ferrite green sheet being a magnetic body material with a desired film thickness was manufactured.

(3) Manufacture of Multilayer Inductor

By applying an Ag paste on the non-magnetic sheet through screen printing and then drying it, a non-magnetic printing sheet having a predetermined conductor pattern (coil pattern) was manufactured. By applying an Ag paste on the magnetic sheet through screen printing and then drying it in the same manner as the above, a magnetic printing sheet having a predetermined conductor pattern (coil pattern) was manufactured.

These non-magnetic sheet and magnetic sheet were stacked so as to form a coil in the inside of a chip and then subjected to thermal pressure bonding. This pressure bonding body was cut so as to form a predetermined chip dimension, and subjected to debinding and firing at a predetermined temperature for a predetermined time.

On an end surface of this chip on which an extended electrode of the coil pattern was exposed, by applying an outer electrode paste through a dipping method and baking a coating film at a predetermined temperature and a predetermined time, a multilayer inductor was obtained.

Second Embodiment

Figure 5A:
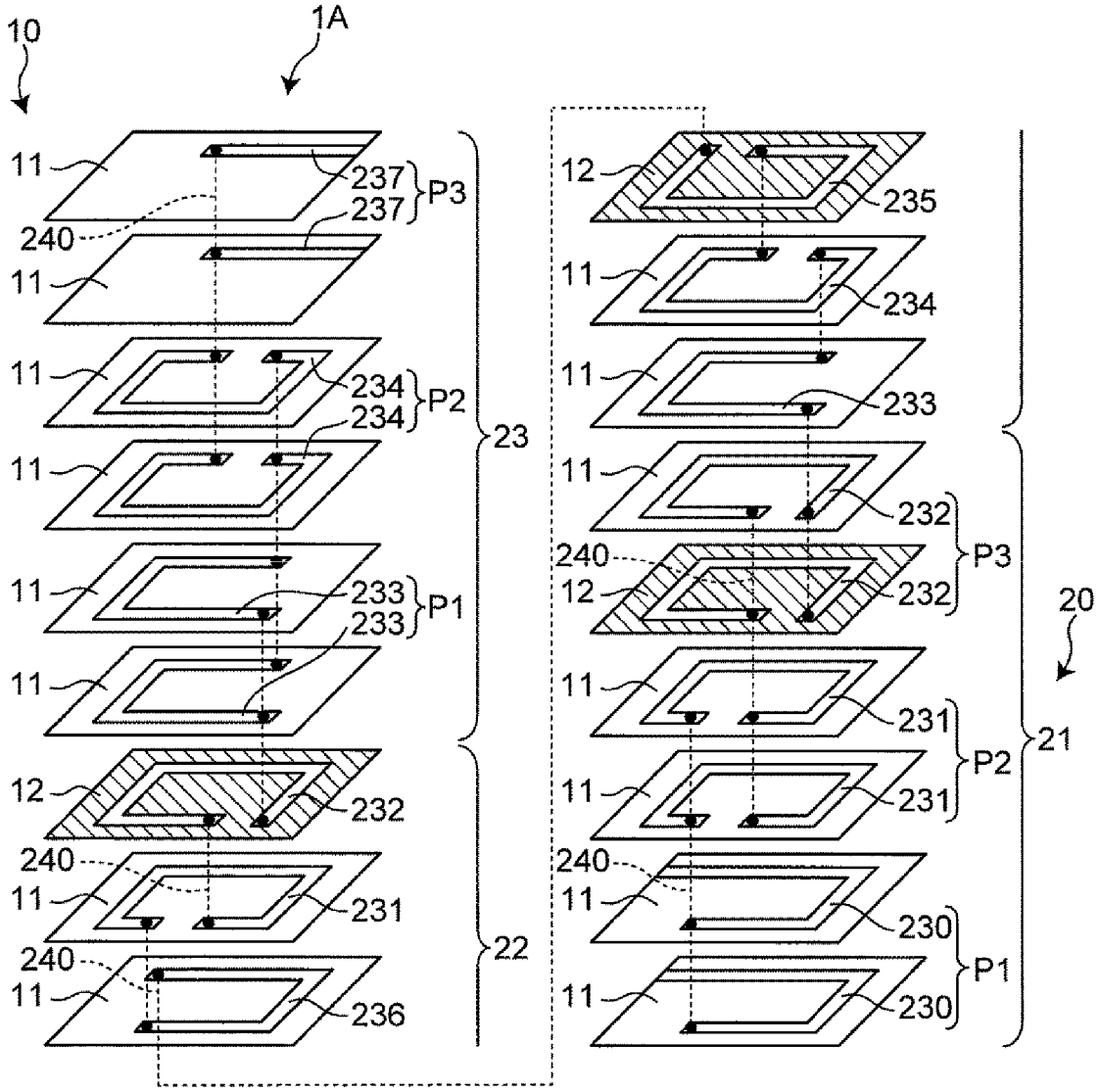
FIG. 5A is an exploded perspective view illustrating a second embodiment of the multilayer inductor of the present disclosure.
Figure 5B:
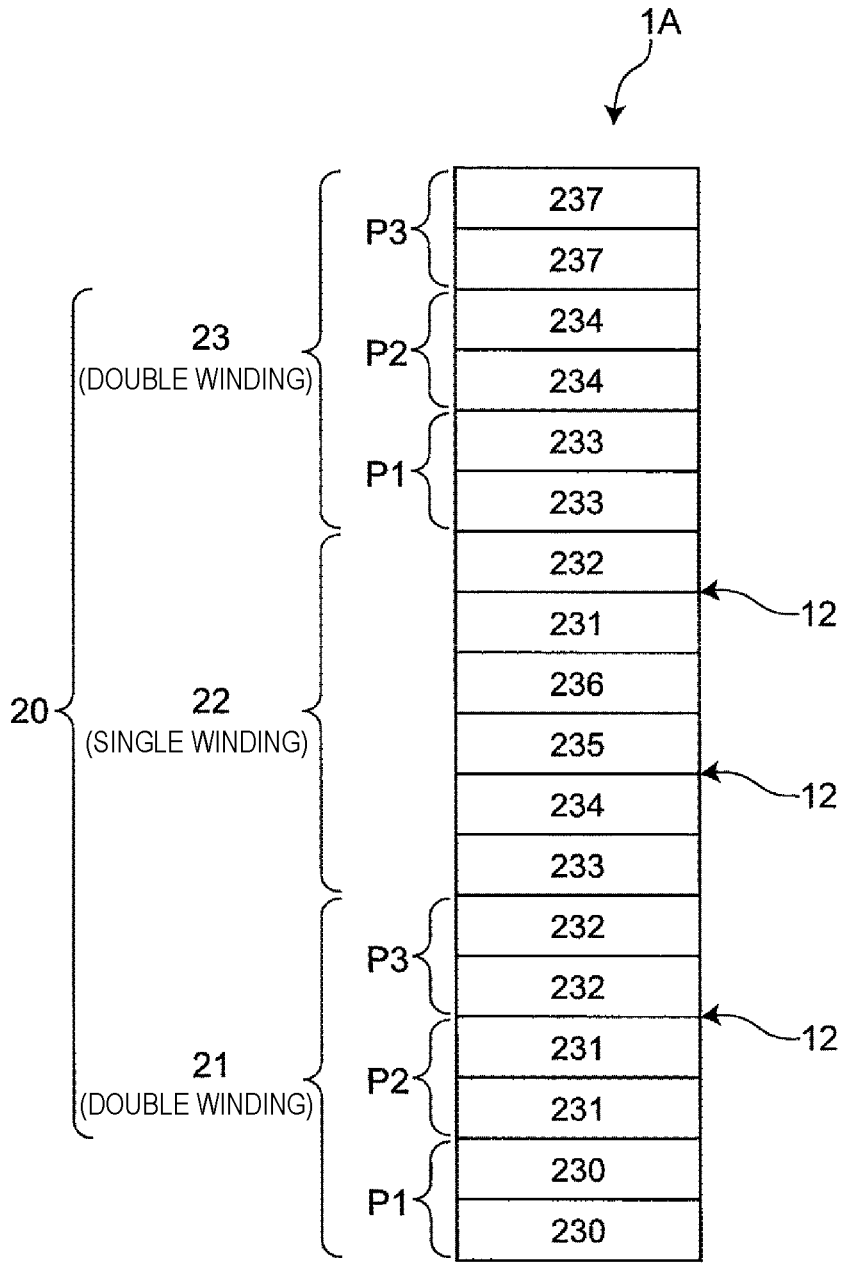
FIG. 5B is a schematic diagram of the multilayer inductor of the present disclosure.

FIG. 5A is an exploded perspective view illustrating a second embodiment of the multilayer inductor of the present disclosure. FIG. 5B is a schematic diagram of the multilayer inductor of the present disclosure. The second embodiment is different from the first embodiment in a location of the non-magnetic insulating layer. This different configuration will be described below. Other configurations are the same as the configurations of the first embodiment, and thus the same reference numerals as those of the first embodiment will be given and descriptions thereof will be omitted.

As illustrated in FIG. 5A and FIG. 5B, in a multilayer inductor 1A of the second embodiment, at least one of the insulating layers adjacent to the coil patterns 231 to 236 included in the second coil group 22 having the least number of parallels (which is one) is the non-magnetic insulating layer 12. To be specific, in the second coil group 22, the non-magnetic insulating layers 12 are respectively provided between the coil pattern 234 and the coil pattern 235, and between the coil pattern 231 and the coil pattern 232. Furthermore, the non-magnetic insulating layer 12 is provided between the second pattern group P2 and the third pattern group P3 of the first coil group 21.

According to the multilayer inductor 1A, although, in the second coil group 22 having the least number of parallels, a large current flows and a magnetic flux increases, since at least one of the insulating layers adjacent to the coil patterns included in this second coil group 22 is the non-magnetic insulating layer 12, the magnetic flux is suppressed, a hysteresis linearity is improved, and thus the voice distortion characteristics are improved.

Figure 6:
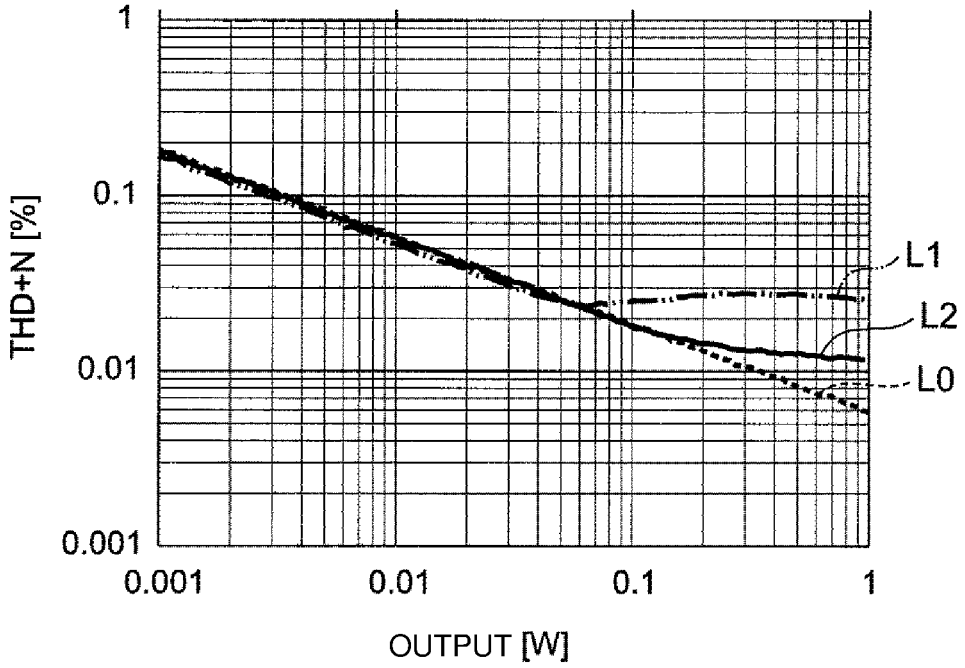
FIG. 6 is a graph of a measurement result of the voice distortion.

FIG. 6 illustrates a graph of a measurement result of the voice distortion. The same measurement as in the first embodiment was performed. A graph L2 illustrates a measurement result of the multilayer inductor of the second embodiment. A graph L1 illustrates a measurement result of the multilayer inductor of the first embodiment. A graph L0 illustrates the short-circuit state. As is clear from FIG. 6, the multilayer inductor (graph L2) of the second embodiment could further improve the voice distortion THD+N [%] in comparison with the multilayer inductor (graph L1) of the first embodiment.

Figure 7:
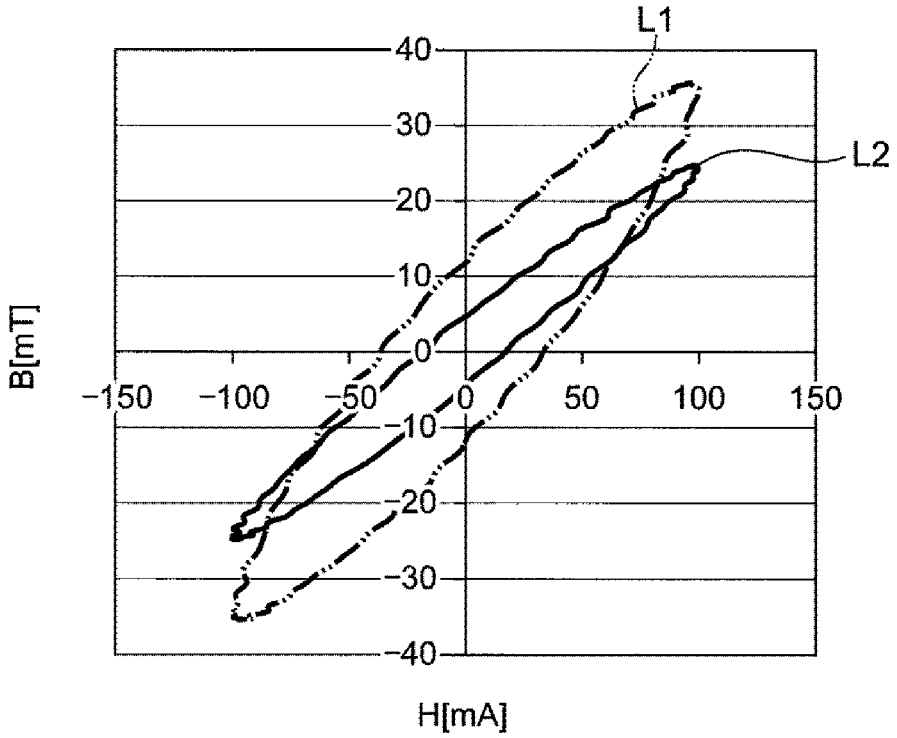
FIG. 7 is a graph of a B-H curve illustrating a hysteresis linearity.

FIG. 7 illustrates a graph of a hysteresis linearity. A B-H curve at about 1 kHz is shown. A graph L2 illustrates a hysteresis linearity of the multilayer inductor of the second embodiment. A graph L1 illustrates a hysteresis linearity of the multilayer inductor of the first embodiment. As is clear from FIG. 7, the multilayer inductor (graph L2) of the second embodiment could improve the hysteresis linearity in comparison with the multilayer inductor (graph L1) of the first embodiment.

As described above, by disposing the non-magnetic insulating layer in the coil group having the small number of parallels in which the current increases, a concentration of the magnetic flux was suppressed, the hysteresis linearity could be improved, and as a result, the voice distortion could be improved.

Preferably, the insulating layer located at the center of the coil group having the least number of parallels in the lamination direction is the non-magnetic insulating layer. With this, by disposing the non-magnetic insulating layer at the center portion with a high magnetic flux density, the magnetic flux is suppressed, and thus the voice distortion characteristics are improved.

Third Embodiment

Figure 8A:
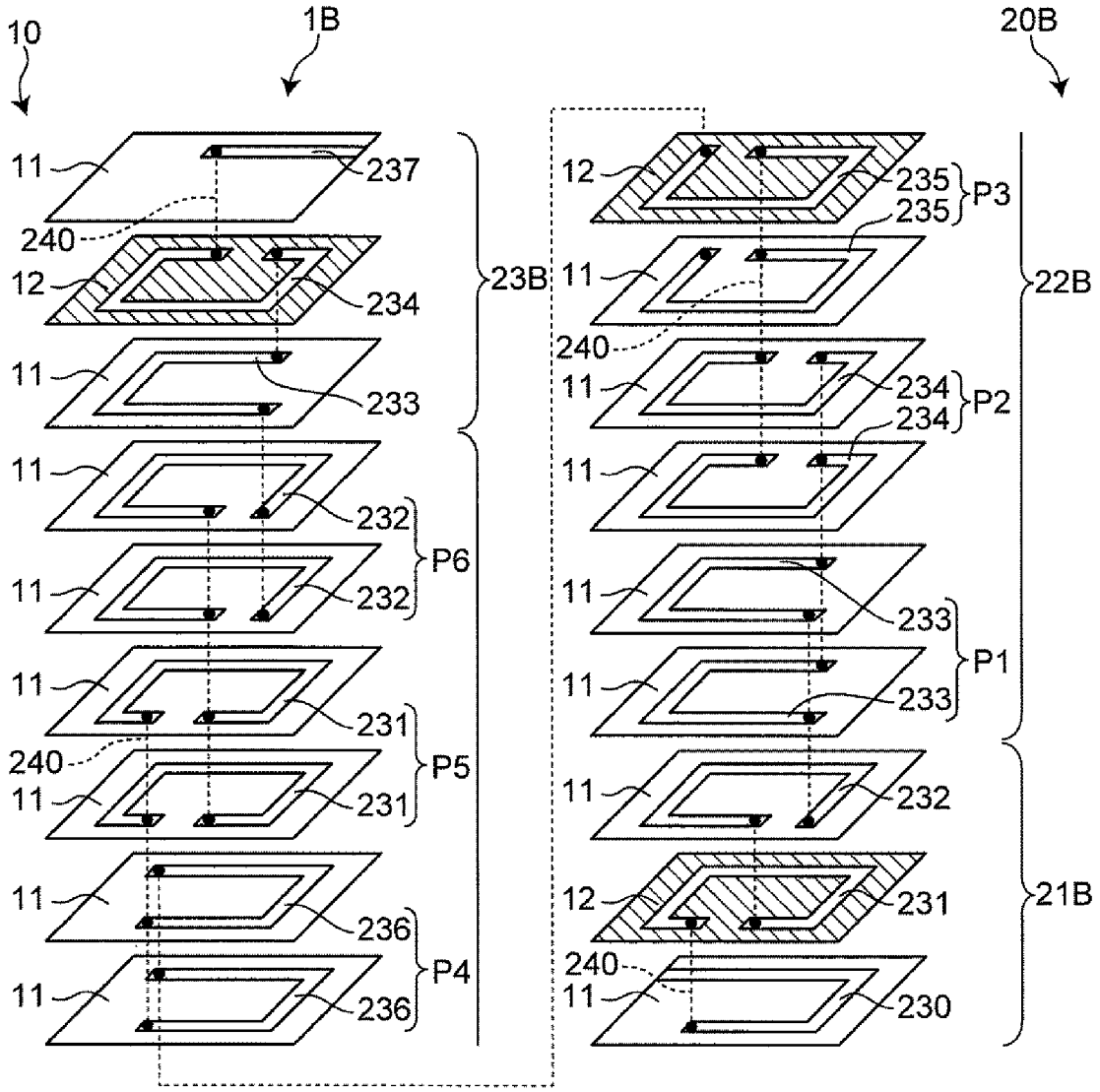
FIG. 8A is an exploded perspective view illustrating a third embodiment of the multilayer inductor of the present disclosure.
Figure 8B:
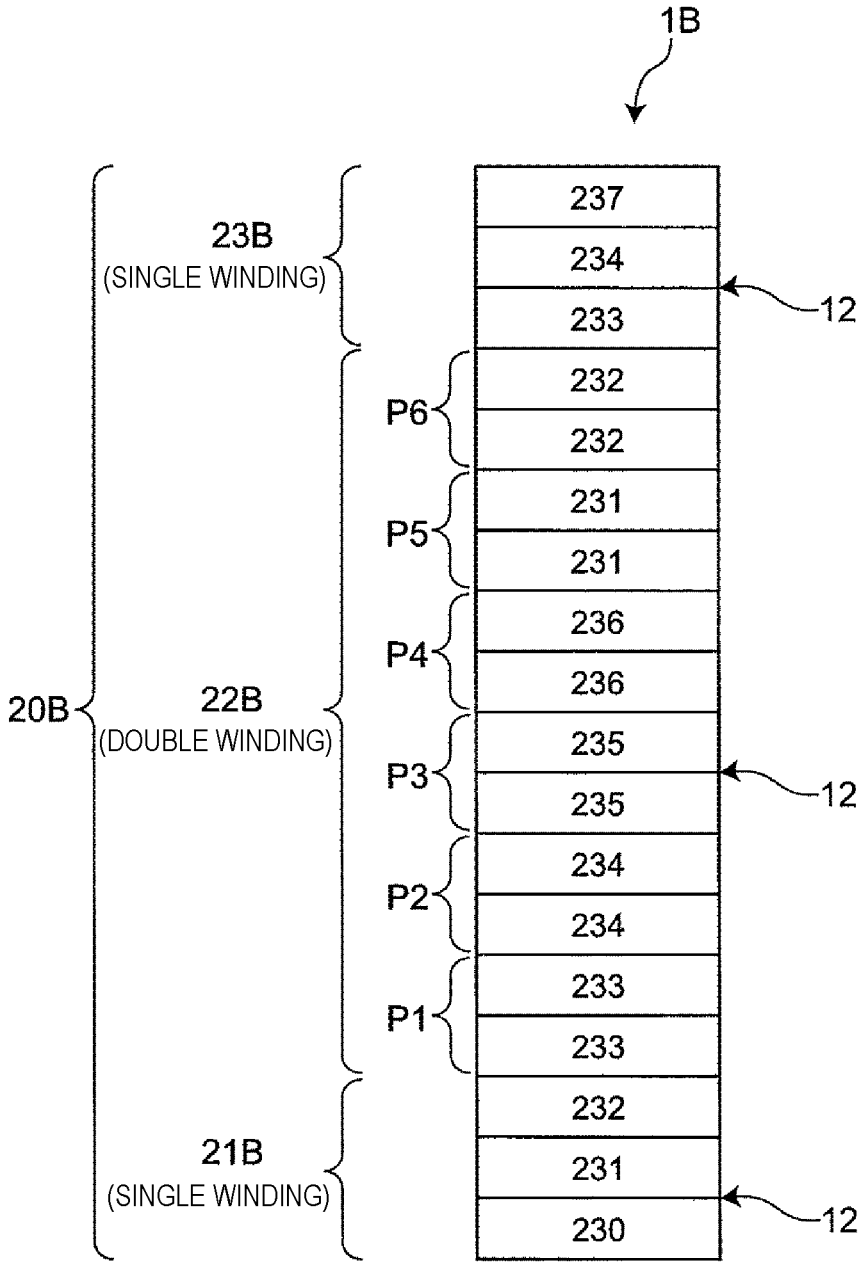
FIG. 8B is a schematic diagram of the multilayer inductor of the present disclosure.

FIG. 8A is an exploded perspective view illustrating a third embodiment of the multilayer inductor of the present disclosure. FIG. 8B is a schematic diagram of the multilayer inductor of the present disclosure. The third embodiment is different from the second embodiment in a location of the coil group having the least number of parallels. This different configuration will be described below. Other configurations are the same as the configurations of the second embodiment, and thus the same reference numerals as those of the second embodiment will be given and descriptions thereof will be omitted.

As illustrated in FIG. 8A and FIG. 8B, in a coil 20B of a multilayer inductor 1B of the third embodiment, the coil groups having the least number of parallels are disposed in outer side portions in the lamination direction. To be specific, a first coil group 21B and a third coil group 23B in each of which the number of parallels is one are disposed on both sides of a second coil group 22B in which the number of parallels is two in the lamination direction.

The first coil group 21B includes the three coil patterns 230, 231, and 232 connected in series. The third coil group 23B includes the three coil patterns 233, 234, and 237 connected in series.

The second coil group 22B includes six pattern groups P1 to P6. A first pattern group P1 is formed by connecting the two coil patterns 233 and 233 in parallel. A second pattern group P2 is formed by connecting the two coil patterns 234 and 234 in parallel. A third pattern group P3 is formed by connecting the two coil patterns 235 and 235 in parallel. A fourth pattern group P4 is formed by connecting the two coil patterns 236 and 236 in parallel. A fifth pattern group P5 is formed by connecting the two coil patterns 231 and 231 in parallel. A sixth pattern group P6 is formed by connecting the two coil patterns 232 and 232 in parallel.

The non-magnetic insulating layers 12 are respectively disposed between the coil pattern 230 and the coil pattern 231 of the first coil group 21B, between the coil pattern 233 and the coil pattern 234 of the third coil group 23B, and between the coil pattern 235 and the coil pattern 235 of the second coil group 22B.

Figure 9:
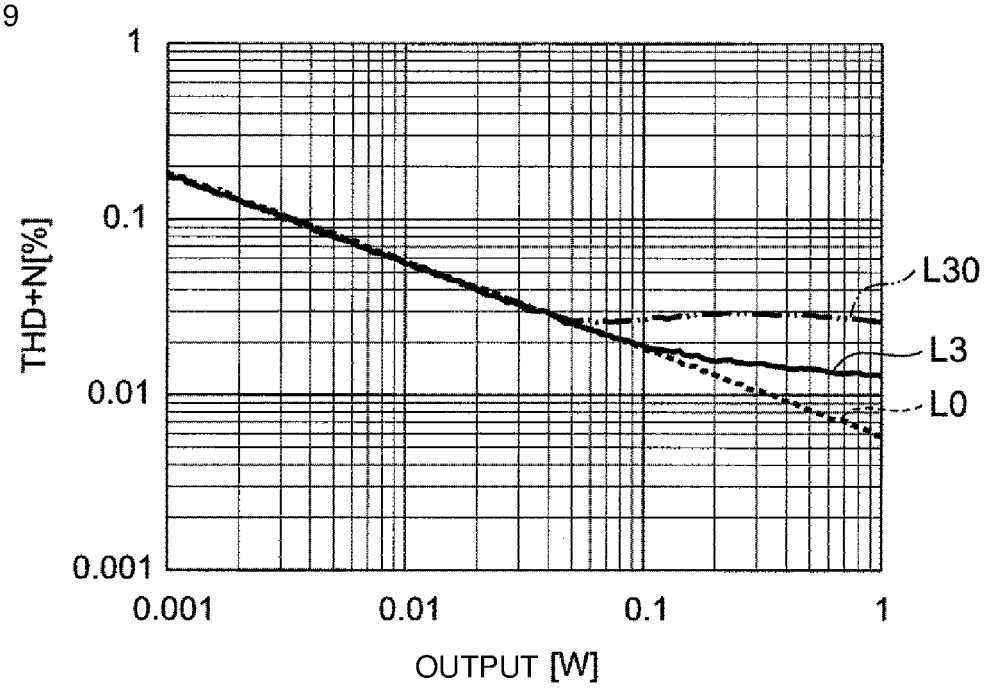
FIG. 9 is a graph of a measurement result of the voice distortion.

FIG. 9 illustrates a graph of a measurement result of the voice distortion. The same measurement as in the first embodiment was performed. A graph L3 illustrates a measurement result of the multilayer inductor of the third embodiment. A graph L30 illustrates a measurement result of a multilayer inductor of a comparative example. The comparative example has a configuration in which all the non-magnetic insulating layers 12 in FIG. 8B are disposed in the second coil group 22B. As is clear from FIG. 9, the multilayer inductor of the third embodiment (graph L3) could improve the voice distortion THD+N [%] in comparison with the multilayer inductor of the comparative example (graph L30).

Figure 10:
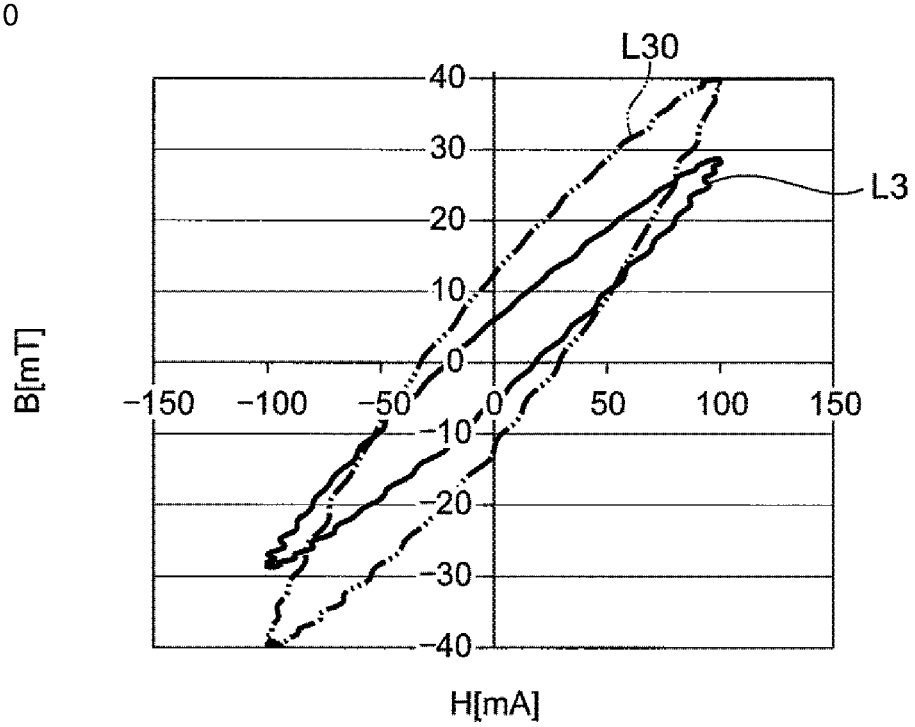
FIG. 10 is a graph of a B-H curve illustrating a hysteresis linearity.

FIG. 10 illustrates a graph of a hysteresis linearity. A B-H curve at about 1 kHz is illustrated. A graph L3 illustrates a hysteresis linearity of the multilayer inductor of the third embodiment. A graph L30 illustrates a hysteresis linearity of the multilayer inductor of the comparative example. As is clear from FIG. 10, the multilayer inductor of the third embodiment (graph L3) could improve the hysteresis linearity in comparison with the multilayer inductor of the comparative example (graph L30).

As described above, by disposing the non-magnetic insulating layer in the coil group having the small number of parallels in which the current increases, the concentration of the magnetic flux was suppressed, the hysteresis linearity could be improved, and as a result, the voice distortion could be improved.

According to the multilayer inductor 1B, although, in the coil group having the least number of parallels, a large current flows and heat generation increases, by disposing these coil groups in the outer side portions in the lamination direction, heat radiation characteristics of a chip are improved and a rated current can be increased.

Figure 11:
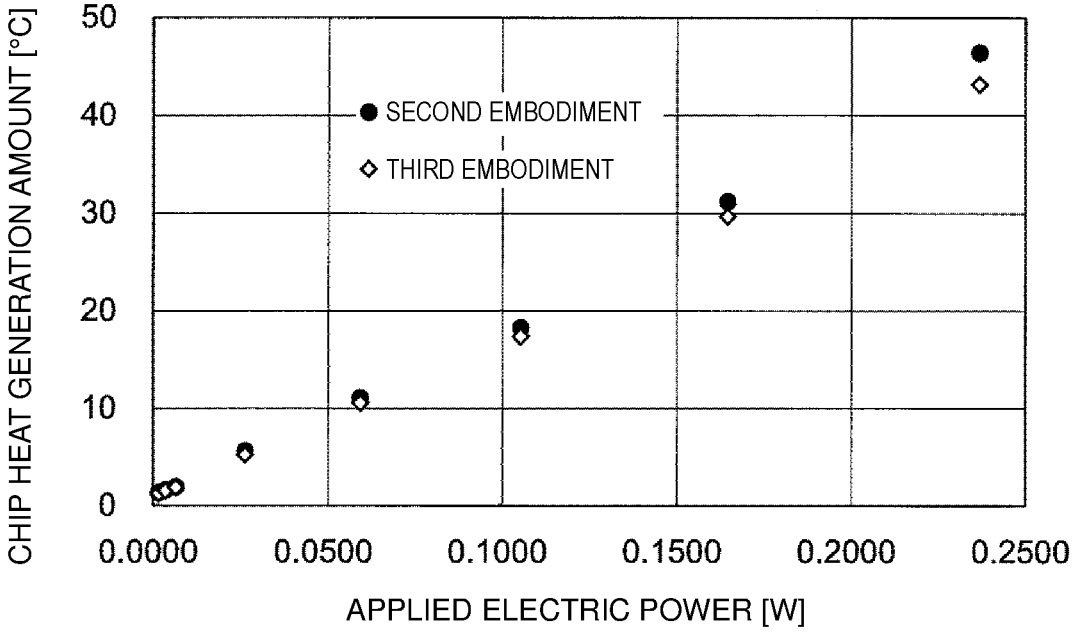
FIG. 11 is a graph of a result obtained by measuring a heat generation amount with respect to applied electric power through a resistance method.

FIG. 11 illustrates a graph of a result obtained by measuring a heat generation amount with respect to applied electric power through a resistance method. A result of the multilayer inductor of the second embodiment is indicated by "●", a result of the multilayer inductor of the third embodiment is indicated by "◇". As is clear from FIG. 11, the multilayer inductor of the third embodiment can suppress heat generation amount at the same electric power in comparison with the multilayer inductor of the second embodiment, and as a result, can increase the rated current of the chip.

Fourth Embodiment

Figure 12A:
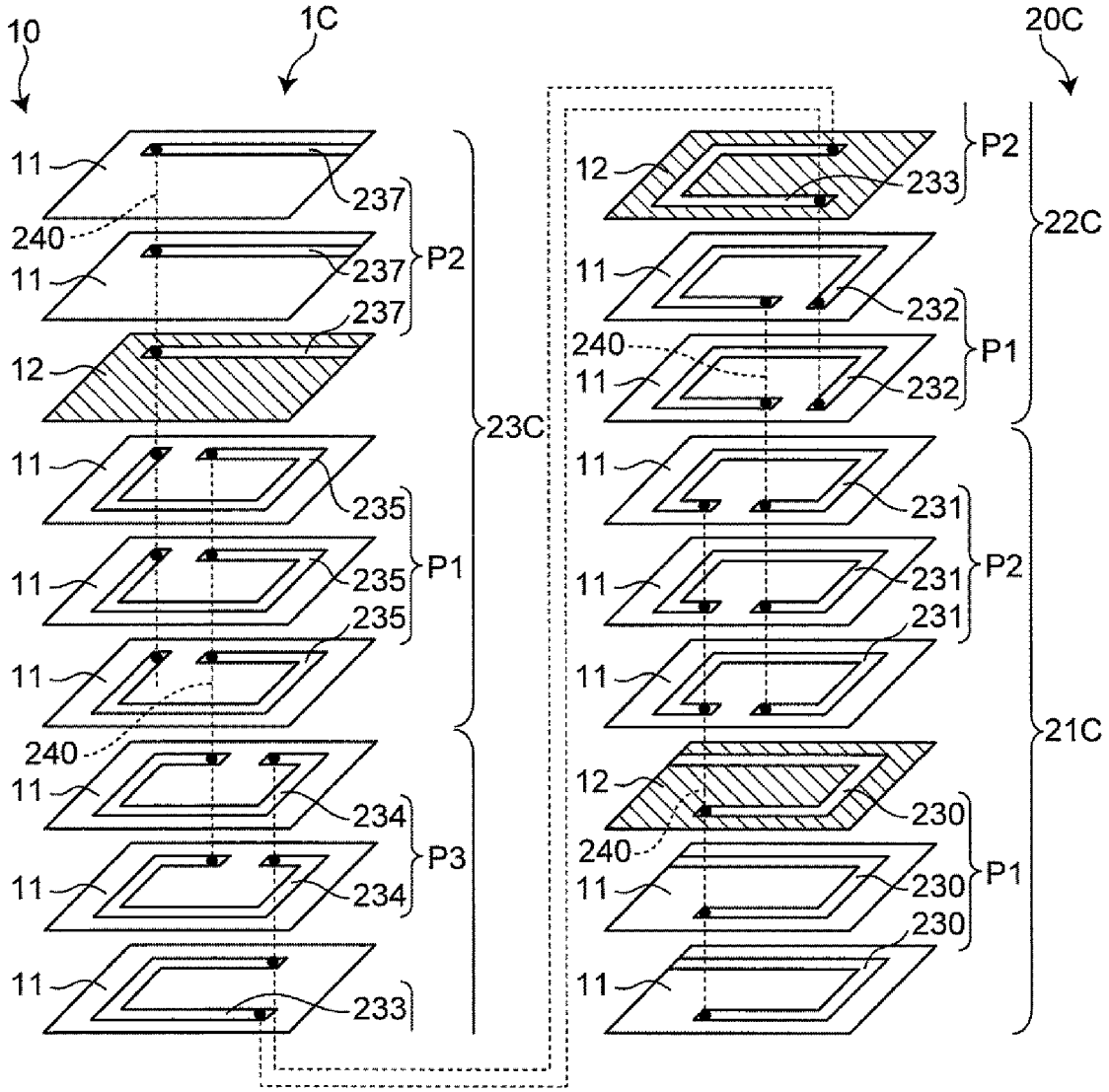
FIG. 12A is an exploded perspective view illustrating a fourth embodiment of the multilayer inductor of the present disclosure.
Figure 12B:
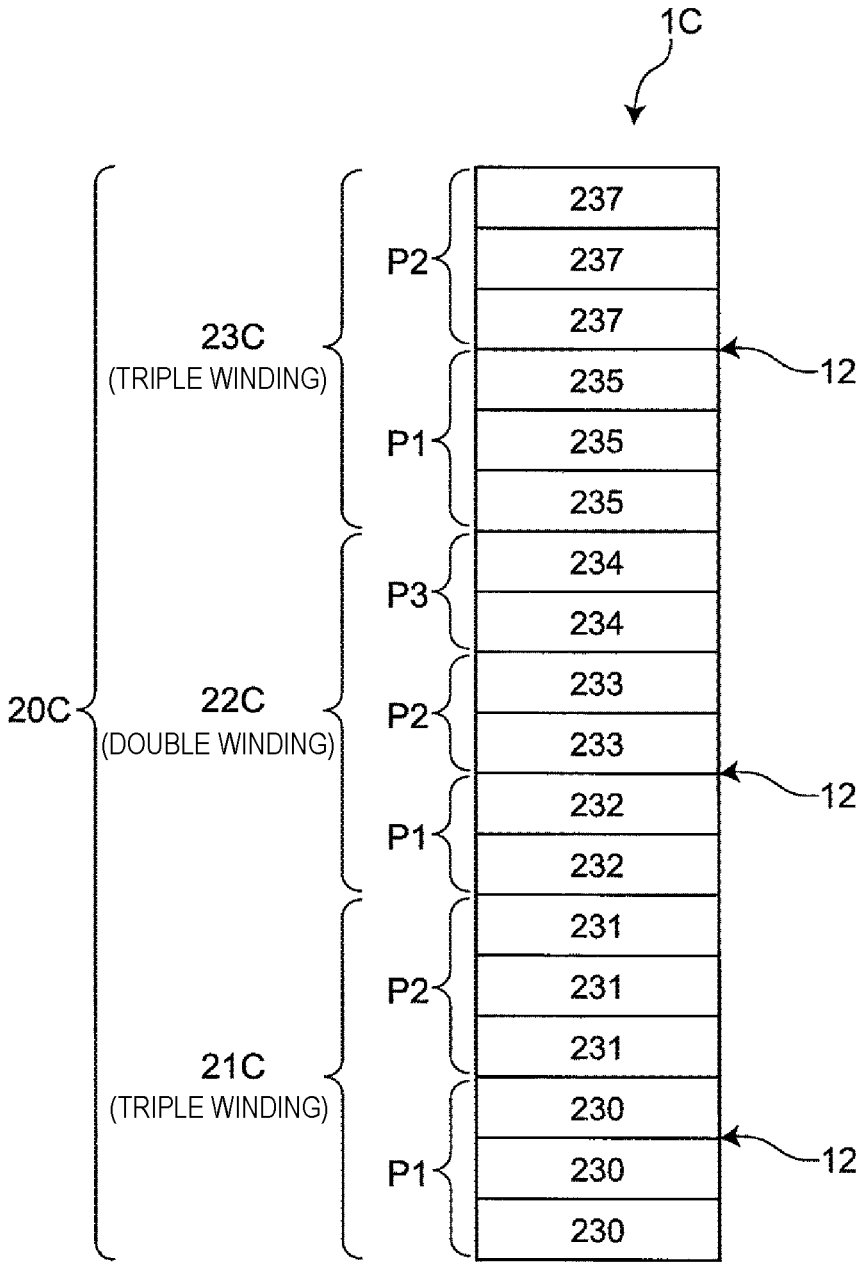
FIG. 12B is a schematic diagram of the multilayer inductor of the present disclosure.

FIG. 12A is an exploded perspective view illustrating a fourth embodiment of the multilayer inductor of the present disclosure. FIG. 12B is a schematic diagram of the multilayer inductor of the present disclosure. The fourth embodiment is different from the second embodiment in the number of parallels of the coil group. This different configuration will be described below. Other configurations are the same as the configurations of the second embodiment, and thus the same reference numerals as those of the second embodiment will be given and descriptions thereof will be omitted.

As illustrated in FIG. 12A and FIG. 12B, in a coil 20C of a multilayer inductor 1C of the fourth embodiment, the number of parallels of each of a first coil group 21C and a third coil group 23C is three, and the number of parallels of a second coil group 22C is two.

The first coil group 21C includes two pattern groups P1 and P2. The first pattern group P1 is formed by connecting the three coil patterns 230 in parallel. The second pattern group P2 is formed by connecting the three coil patterns 231 in parallel.

The second coil group 22C includes three pattern groups P1, P2, and P3. The first pattern group P1 is formed by connecting the two coil patterns 232 and 232 in parallel. The second pattern group P2 is formed by connecting the two coil patterns 233 and 233 in parallel. The third pattern group P3 is formed by connecting the two coil patterns 234 and 234 in parallel.

The third coil group 23C includes two pattern groups P1 and P2. The first pattern group P1 is formed by connecting the three coil patterns 235 in parallel. The second pattern group P2 is formed by connecting the three coil patterns 237 in parallel.

The non-magnetic insulating layers 12 are respectively disposed between the two coil patterns 230 and 230 of the first coil group 21C, between the coil pattern 232 and the coil pattern 233 of the second coil group 22C, and between the coil pattern 235 and the coil pattern 237 of the third coil group 23C.

Figure 13:
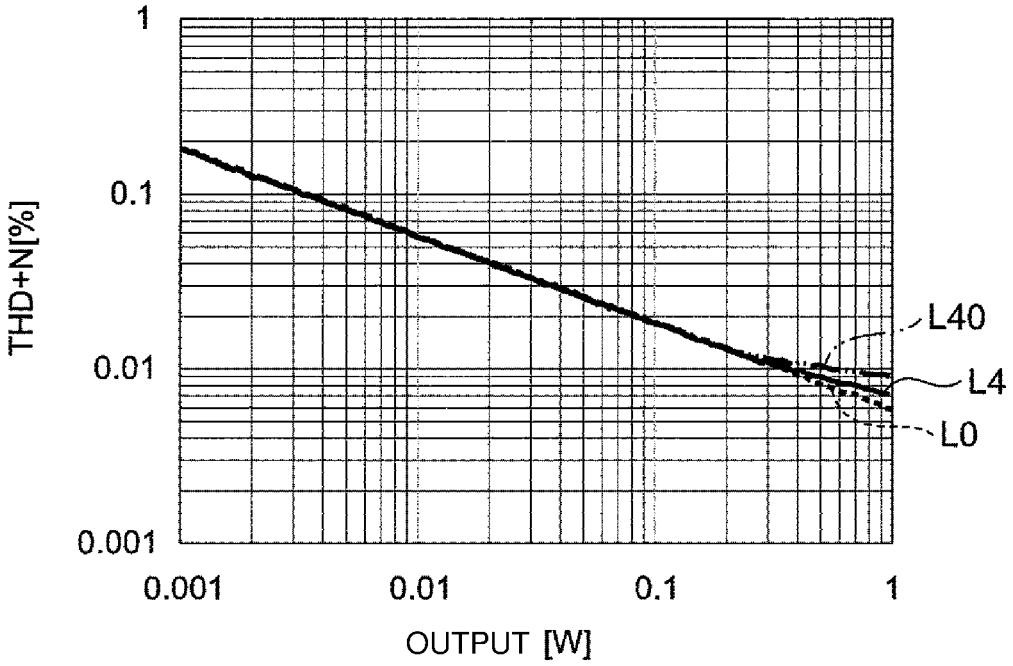
FIG. 13 is a graph of a measurement result of the voice distortion.

FIG. 13 illustrates a graph of a measurement result of the voice distortion. The same measurement as in the first embodiment was performed. A graph L4 illustrates a measurement result of the multilayer inductor of the fourth embodiment. A graph L40 illustrates a measurement result of a multilayer inductor of a comparative example. The comparative example has a configuration in which all the non-magnetic insulating layers 12 in FIG. 12B are disposed in the first coil group 21C and the third coil group 23C. As is clear from FIG. 13, the multilayer inductor of the fourth embodiment (graph L4) could improve the voice distortion THD+N [%] in comparison with the multilayer inductor of the comparative example (graph L40).

As described above, by disposing the non-magnetic insulating layer in the coil group having the small number of parallels in which the current increases, the concentration of the magnetic flux was suppressed, the hysteresis linearity could be improved, and as a result, the voice distortion could be improved.

FIG. 14A to FIG. 14F illustrate the multilayer inductors each having coil groups which are different in number of parallels (the number of turns).

FIG. 14A illustrates the multilayer inductor including a single winding first coil group, a double winding second coil group, and a single winding third coil group. FIG. 14B illustrates the multilayer inductor including a single winding first coil group, a double winding second coil group, a single winding third coil group, a double winding fourth coil group, and a single winding fifth coil group. FIG. 14C illustrates the multilayer inductor including a double winding first coil group, a single winding second coil group, and a double winding third coil group.

FIG. 14D illustrates the multilayer inductor including a single winding first coil group, a double winding second coil group, a triple winding third coil group, a quadruple winding fourth coil group, a triple winding fifth coil group, a double winding sixth coil group, and a single winding seventh coil group. FIG. 14E illustrates the multilayer inductor including a double winding first coil group and a single winding second coil group. FIG. 14F illustrates the multilayer inductor including a triple winding first coil group, a double winding second coil group, and a triple winding third coil group.

As illustrated in FIG. 14A to FIG. 14F, in the coil groups which are different in the number of parallels (the number of turns), at least one of the insulating layers adjacent to the coil patterns included in the coil group having the least number of parallels is the non-magnetic insulating layer.

Here, in the drawings, in a column of an insertion position, a position where the non-magnetic insulating layer is inserted is indicated by "○". In a column of the coil pattern, the coil patterns of the coil groups which are different in the number of turns are illustrated. For example, in a case where "single winding" is illustrated in the column of the coil pattern, the coil pattern of the single winding coil group is indicated.

Additionally, in a case where "○" is illustrated in the column of a predetermined coil pattern, between the predetermined coil pattern and the coil pattern above the predetermined coil pattern, the non-magnetic insulating layer is assumed to be inserted. In each of the drawings, the non-magnetic insulating layer may be inserted in at least one of all positions of "○".

Accordingly, by disposing the non-magnetic insulating layer in the coil group having the small number of parallels in which the current increases, the concentration of the magnetic flux is suppressed, the hysteresis linearity can be improved, and as a result, the voice distortion can be improved.

Fifth Embodiment

Figure 15:
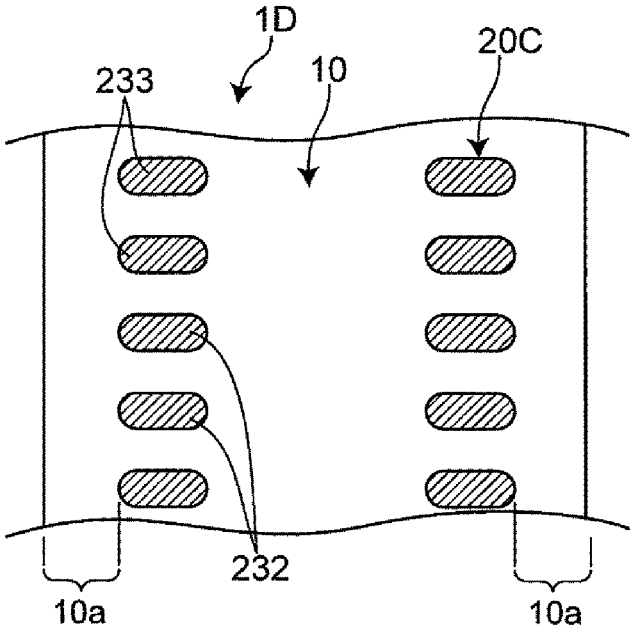
FIG. 15 is a cross-sectional view illustrating a fifth embodiment of the multilayer inductor of the present disclosure.

FIG. 15 is a cross-sectional view illustrating a fifth embodiment of the multilayer inductor of the present disclosure. The fifth embodiment is different from the fourth embodiment in a point that a pore area ratio of the multilayer body is defined. This different configuration will be described below. Other configurations are the same as the configurations of the fourth embodiment, and thus the same reference numerals as those of the fourth embodiment will be given and descriptions thereof will be omitted.

As illustrated in FIG. 15, in a multilayer inductor 1D in the fifth embodiment, a pore area ratio of the multilayer body 10 in a side gap portion 10*a* which is a region between side portions of the coil patterns 232 and 233 and the side surface of the multilayer body 10 is not less than about 6% and not more than about 20% (i.e., from about 6% to about 20%).

The pore area ratio was measured through the following method.

The multilayer body 10 was cut at the substantially center in a direction in which the first end surface 15 and the second end surface 16 oppose each other, a cross section at a position of the side gap portion 10*a* was mirror-polished, and subjected to focused ion beam processing (FIB processing) (FIB device: FIB200TEM manufactured by FEI). Thereafter, observation under a scanning electron microscope (FE-SEM: JSM-7500FA manufactured by JEOL Ltd.) was performed, and the pore area ratio was measured. The pore area ratio was calculated using image processing software (WINROOF Ver. 5.6 manufactured by MITANI CORPORATION).

Note that, conditions of the focused ion beam processing and the observation under the FE-SEM of the multilayer body 10 are as follows.

Condition of Focused Ion Beam Processing (FIB Processing)

FIB processing was performed at an incident angle of 5° to the polished surface of the mirror-polished sample.

Conditions of Observation Under Scanning Electron Microscope (SEM)

Acceleration Voltage: 15 kV
Sample Inclination: 0°
Signal: secondary electron
Coating: Pt
Magnification: 5000 times Additionally, the pore area ratio was obtained through the following method using the image processing software.

First, a measurement range of the image was set to about 22.85 μm×9.44 μm. Next, the image obtained under FE-SEM is subjected to binarization processing to extract only pores. An area of the measurement range and an area of the pores were calculated using a "total area and number measurement" function of the image processing software, a ratio of the area of the pores per the area of the measurement range (pore area ratio) was obtained.

According to the multilayer inductor 1D, permeation of an acidic solution including a metal from the side surface of the multilayer body 10 through the side gap portion 10*a* to reach a boundary surface between the coil patterns 232 and 233 and the insulating layers 11 and 12 of the multilayer body 10 in the periphery thereof makes the boundary surface between the coil patterns 232 and 233 and the insulating layers 11 and 12 a chemically dissociated state. With this, a stress of the multilayer body 10 can be eased, inhibition of a magnetic domain wall movement necessary for the magnetic insulating layer 11 to exhibit magnetic characteristics is reduced, the hysteresis linearity is improved, and thus the voice distortion characteristics are improved.

Note that, if the pore area ratio in the side gap portion 10*a* becomes less than about 6%, it becomes difficult to cause the acidic solution including the metal to reach the boundary surface between the coil patterns and the multilayer body in the periphery thereof, and to cause the boundary surface to have a gap and to be a dissociated state. Additionally, if the pore area ratio in the side gap portion 10*a* exceeds about 20%, there is a risk increase of a short-circuit by metal deposition in the inside of the multilayer inductor being excessively increased, which is not preferable.

Figure 16:
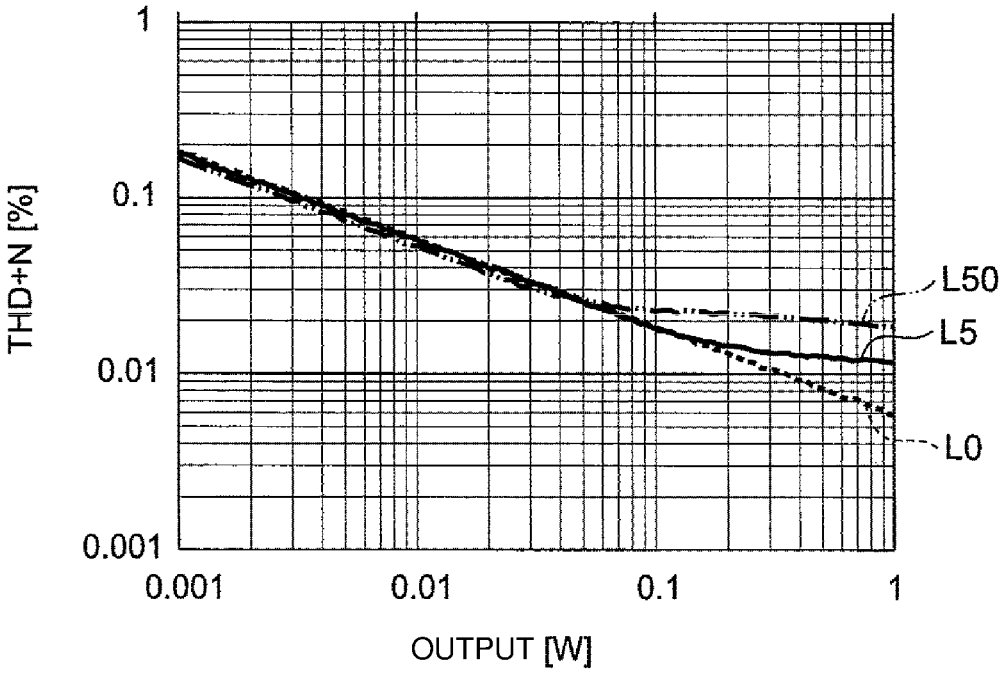
FIG. 16 is a graph of a measurement result of the voice distortion.

FIG. 16 illustrates a graph of a measurement result of the voice distortion. The same measurement as in the first embodiment was performed. A graph L5 illustrates a measurement result of the multilayer inductor of the fifth embodiment. In the fifth embodiment, the pore area ratio in the side gap portion 10*a* is about 10%. A graph L50 illustrates a measurement result of a multilayer inductor of a comparative example. In the comparative example, the pore area ratio in the side gap portion 10*a* is about 1%. As is clear from FIG. 16, the multilayer inductor of the fifth embodiment (graph L5) could improve the voice distortion THD+N [%] in comparison with the multilayer inductor of the comparative example (graph L50).

Sixth Embodiment

A sixth embodiment of the multilayer inductor of the present disclosure will be described. The sixth embodiment is different from the fourth embodiment in a point that a proportion of the pore area ratios of the non-magnetic insulating layer and the magnetic insulating layer of the multilayer body is defined.

In the sixth embodiment, the pore area ratio of the non-magnetic insulating layer is smaller than the pore area ratio of the magnetic insulating layer. According to this configuration, although the non-magnetic insulating layer adjacent to the coil pattern of the coil group in which a large current flows is located at a position with a high risk of a short-circuit due to electrochemical migration under a high temperature and high humidity environment or the like, by reducing the pore area ratio of this non-magnetic insulating layer, reliability at the high risk position is improved, and thus the reliability of the multilayer inductor can be improved as a whole (the short-circuit risk can be reduced).

Figures 17, 18:
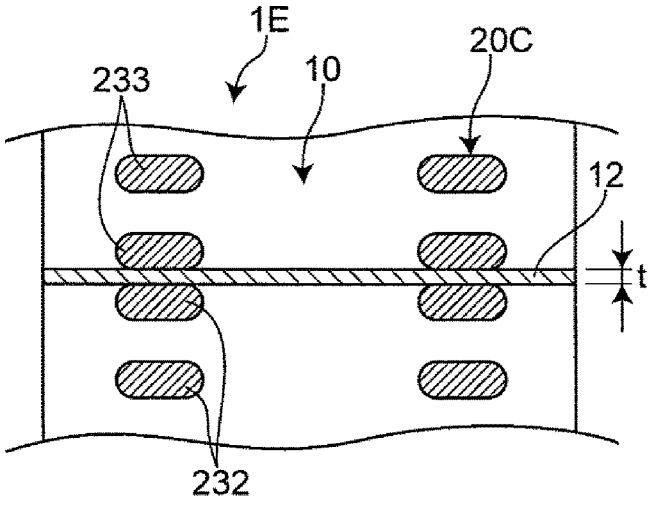
FIG. 17 illustrates test results of a sixth embodiment of the multilayer inductor of the present disclosure and a comparative example.
FIG. 18 is a schematic diagram illustrating a seventh embodiment of the multilayer inductor of the present disclosure and illustrating a thickness of a non-magnetic insulating layer.

FIG. 17 illustrates test results of the sixth embodiment and a comparative example. As illustrated in FIG. 17, in the comparative example, the pore area ratio of the non-magnetic insulating layer is about 10%, the pore area ratio of the magnetic insulating layer is about 9%. In the sixth embodiment, the pore area ratio of the non-magnetic insulating layer is about 1%, the pore area ratio of the magnetic insulating layer is about 9%. An environment acceleration test at about 85° C. and 85% RH was performed. A defect occurrence rate after about 3000 hours have passed when a chip heat generation amount is changed by a test current is illustrated. Accordingly, as indicated in the sixth embodiment, by reducing the pore area ratio of the non-magnetic insulating layer, the reliability of the inductor can be improved, and as a result, the rated current can be increased.

Seventh Embodiment

A seventh embodiment of the multilayer inductor of the present disclosure will be described. The seventh embodiment is different from the sixth embodiment in a point that thicknesses of the non-magnetic insulating layer and the magnetic insulating layer of the multilayer body are defined.

In the seventh embodiment, the thickness of the non-magnetic insulating layer is thinner than the thickness of the magnetic insulating layer. According to this configuration, by increasing the density of the non-magnetic insulating layer with the small pore area ratio, even if the non-magnetic insulating layer is thinned, a high environment-resistant performance can be exhibited. Additionally, by the non-magnetic insulating layer being thinned, high impedance characteristics can be enhanced.

The thickness of the non-magnetic insulating layer is preferably not less than about 5 μm. In FIG. 18, the thickness of the non-magnetic insulating layer is defined. A thickness t of the non-magnetic insulating layer 12 of the multilayer inductor 1 is a thickness between the adjacent coil patterns 232 and 233.

Figure 19:
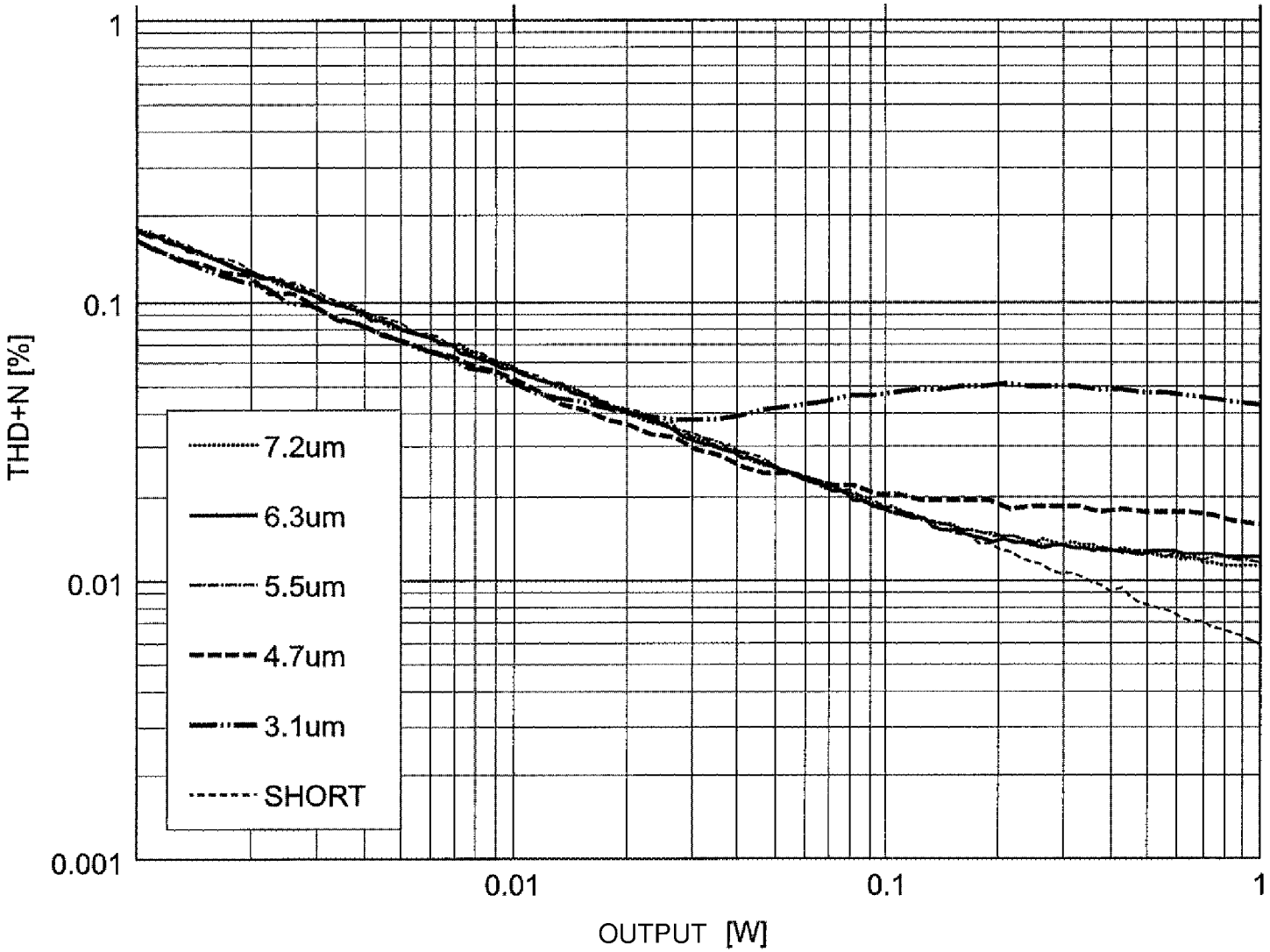
FIG. 19 is a graph of the voice distortion when the thickness of the non-magnetic insulating layer is changed.

FIG. 19 illustrates a graph of the voice distortion when the thickness of the non-magnetic insulating layer is changed. The same measurement as in the first embodiment was performed. As is clear from FIG. 19, if the thickness of the non-magnetic insulating layer is reduced, an output when a short-circuit state (SHORT) cannot be maintained (that is, the voice distortion occurs) decreases. The output at this time is referred to as a rising output of distortion.

Figure 20:
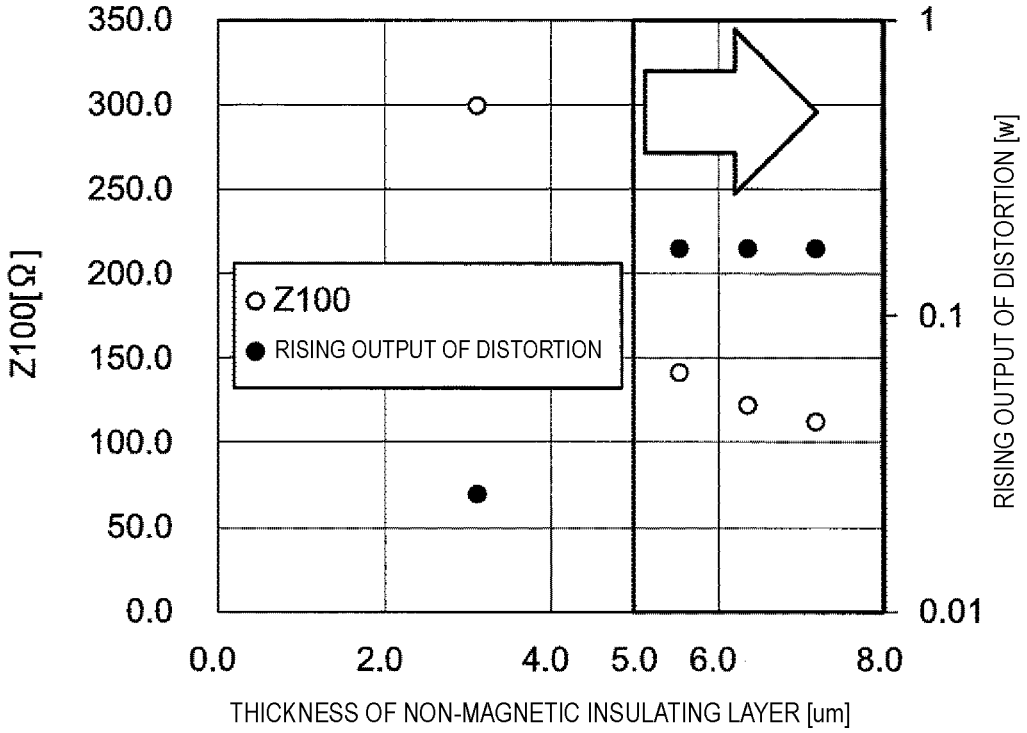
FIG. 20 is a graph illustrating relationships between the thickness of the non-magnetic insulating layer and rising output of the distortion and between the thickness of the non-magnetic insulating layer and Z.

FIG. 20 illustrates relationships between the thickness of the non-magnetic insulating layer and rising output of the distortion and between the thickness of the non-magnetic insulating layer and Z. In FIG. 19, graphs when the thicknesses of the non-magnetic insulating layer are respectively about 5.5 μm, about 6.3 μm, and about 7.2 μm overlap with one another. As illustrated in FIG. 20, although a Z enhancement effect can be expected by reducing the thickness of the non-magnetic insulating layer, if the thickness of the non-magnetic insulating layer is excessively reduced, the rising output of the distortion drops, and thus the thickness of not less than about 5 μm of the non-magnetic insulating layer is preferably ensured.

Eighth Embodiment

Figure 21A:
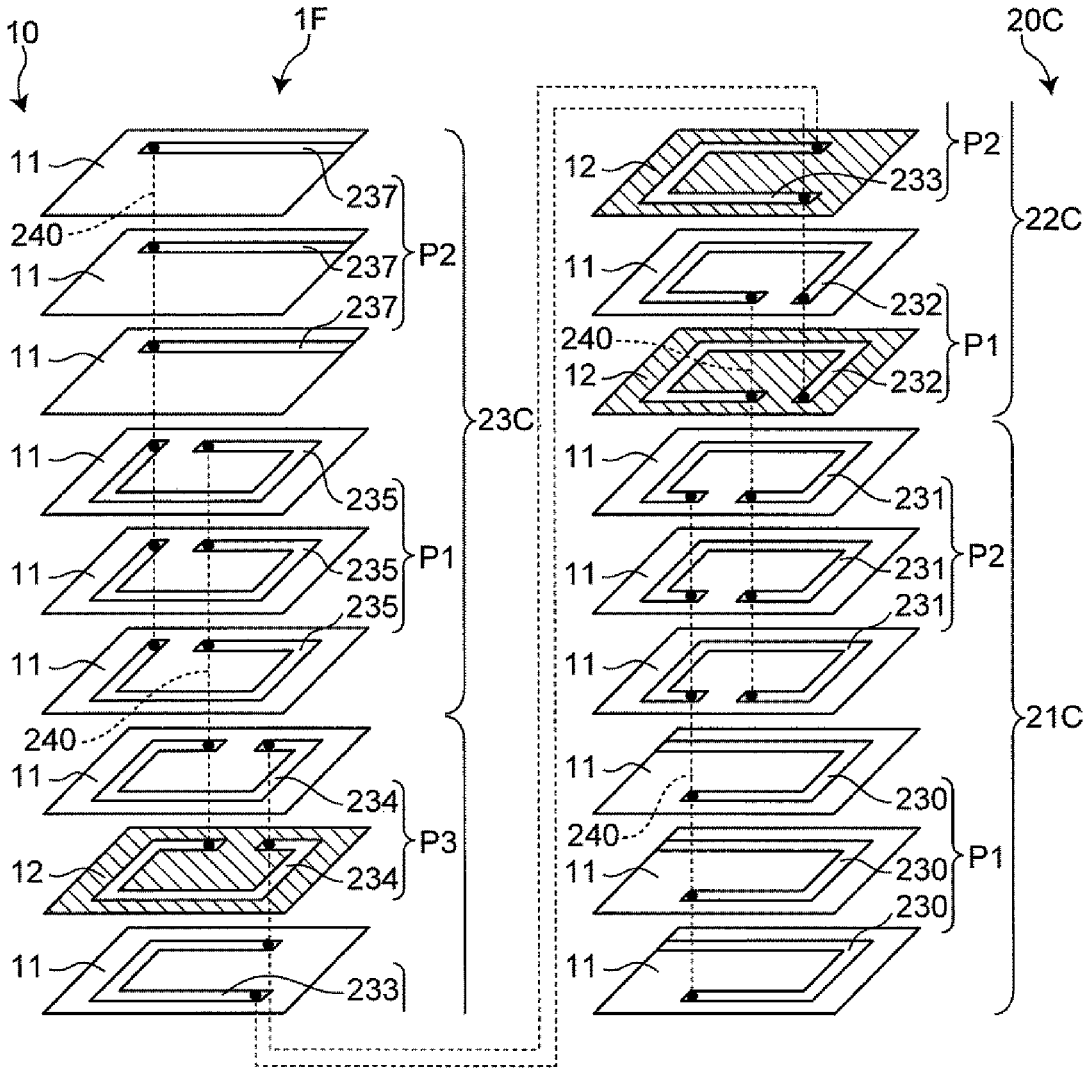
FIG. 21A is an exploded perspective view illustrating an eighth embodiment of the multilayer inductor of the present disclosure.
Figure 21B:
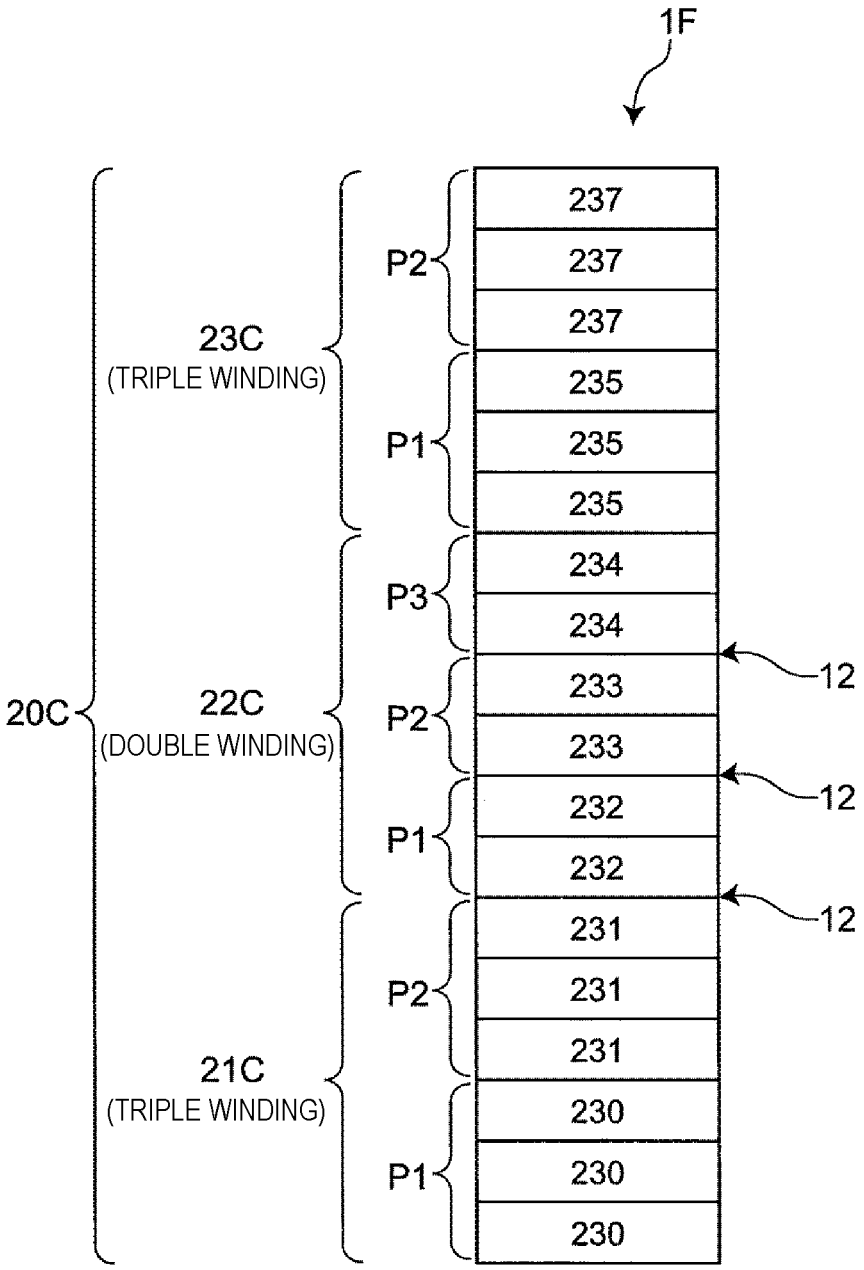
FIG. 21B is a schematic diagram of the multilayer inductor of the present disclosure.

FIG. 21A is an exploded perspective view illustrating an eighth embodiment of the multilayer inductor of the present disclosure. FIG. 21B is a schematic diagram of the multilayer inductor of the present disclosure. The eighth embodiment is different from the sixth embodiment (in which the structure of the coil and the location of the non-magnetic insulating layer are the same as those in FIG. 12A) in a location of the non-magnetic insulating layer. This different configuration will be described below. Other configurations are the same as the configurations of the sixth embodiment, and thus the same reference numerals as those of the sixth embodiment will be given and descriptions thereof will be omitted.

As illustrated in FIG. 21A and FIG. 21B, in a multilayer inductor 1F of the eighth embodiment, the insulating layers located among the adjacent pattern groups P1, P2, and P3 of the second coil group 22C having the least number of parallels (which is two) are the non-magnetic insulating layers 12. To be specific, the non-magnetic insulating layers 12 are respectively provided between the first pattern group P1 and the second pattern group P2 of the second coil group 22C, and between the second pattern group P2 and the third pattern group P3 of the second coil group 22C. Furthermore, the non-magnetic insulating layer 12 is provided between the first coil group 21C and the second coil group 22C.

According to the multilayer inductor 1F, since the adjacent pattern groups P1, P2, and P3 have different potentials, in a case where a short-circuit occurs among the adjacent pattern groups P1, P2, and P3, impedance is influenced. By disposing the non-magnetic insulating layer 12 with the small pore area ratio among these adjacent pattern groups P1, P2, and P3, the reliability of the multilayer inductor can be improved as a whole (the short-circuit risk can be reduced).

FIG. 22 illustrates test results of the eighth embodiment and the sixth embodiment. As illustrated in FIG. 22, in the sixth and eighth embodiments, the pore area ratio of the non-magnetic insulating layer is about 1%, the pore area ratio of the magnetic insulating layer is about 9%. An environment acceleration test at about 85° C. and about 85 RH % was performed. A defect occurrence rate after about 3000 hours have passed when a chip heat generation amount is changed by a test current is illustrated. Accordingly, in the eighth embodiment, in comparison with the sixth embodiment, by inserting the non-magnetic insulating layer into the location where the impedance is influenced, the reliability of the inductor could be further improved.

Note that the present disclosure is not limited to the above-described embodiments, and design changes are possible without departing from the essential spirit of the present disclosure. For example, the features of the first to eighth embodiments may be combined in a variety of ways.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A multilayer inductor comprising:

a multilayer body including a plurality of insulating layers laminated in a lamination direction; and a plurality of coil groups arranged in the multilayer body along the lamination direction and connected in series, wherein each of the coil groups includes a plurality of coil patterns respectively provided on the insulating layers and laminated in the lamination direction, and is configured by connecting a plurality of pattern groups in series, each of the pattern groups being formed by stacking n (n is a positive integer) of the coil patterns in parallel, a number of parallels n of at least one of the coil groups is different from a number of parallels n of another one of the coil groups, and the insulating layers include a magnetic insulating layer and a non-magnetic insulating layer, and at least one of the insulating layers adjacent to one of the coil patterns is the non-magnetic insulating layer, wherein in a coil group with a unique coil pattern, the number of parallels n is one, in a coil group with a repeated coil pattern, the number of parallels n is a number of the same coil patterns in a pattern group, at least one of the insulating layers adjacent to one of the coil patterns included in one of the coil groups having the least number of parallels n is the non-magnetic insulating layer, and the insulating layer located at a center of one of the coil groups having the least number of parallels n in the lamination direction is the non-magnetic insulating layer.

2. The multilayer inductor according to claim 1, wherein the one of the coil groups having the least number of parallels n is disposed in an outer side portion in the lamination direction.

3. The multilayer inductor according to claim 2, wherein a pore area ratio of the multilayer body in a side gap portion which is a region between a side portion of one of the coil patterns and a side surface of the multilayer body is from 6% to 20%.

4. The multilayer inductor according to claim 3, wherein a pore area ratio of the non-magnetic insulating layer is smaller than a pore area ratio of the magnetic insulating layer.

5. The multilayer inductor according to claim 2, wherein a pore area ratio of the non-magnetic insulating layer is smaller than a pore area ratio of the magnetic insulating layer.

6. The multilayer inductor according to claim 1, wherein a pore area ratio of the multilayer body in a side gap portion which is a region between a side portion of one of the coil patterns and a side surface of the multilayer body is from 6% to 20%.

7. The multilayer inductor according to claim 6, wherein a pore area ratio of the non-magnetic insulating layer is smaller than a pore area ratio of the magnetic insulating layer.

8. The multilayer inductor according to claim 1, wherein a pore area ratio of the non-magnetic insulating layer is smaller than a pore area ratio of the magnetic insulating layer.

9. The multilayer inductor according to claim 8, wherein a thickness of the non-magnetic insulating layer is thinner than a thickness of the magnetic insulating layer.

10. The multilayer inductor according to claim 8, wherein the insulating layer located between adjacent pattern groups of the one of the coil groups having the least number of parallels n is the non-magnetic insulating layer.

11. The multilayer inductor according to claim 1, wherein a pore area ratio of the multilayer body in a side gap portion which is a region between a side portion of one of the coil patterns and a side surface of the multilayer body is from 6% to 20%.

12. The multilayer inductor according to claim 11, wherein a pore area ratio of the non-magnetic insulating layer is smaller than a pore area ratio of the magnetic insulating layer.

13. The multilayer inductor according to claim 1, wherein a pore area ratio of the non-magnetic insulating layer is smaller than a pore area ratio of the magnetic insulating layer.

* * * * *